US011019897B2

(12) United States Patent
Penaflor

(10) Patent No.: US 11,019,897 B2
(45) Date of Patent: Jun. 1, 2021

(54) POCKET UTILITY CASE AND TRAVEL TOOL

(71) Applicant: Ronaldo Green Penaflor, Fallbrook, CA (US)

(72) Inventor: Ronaldo Green Penaflor, Fallbrook, CA (US)

(73) Assignee: iP TECH PROS Inc., San Diego, CA (US)

( * ) Notice: Subject to any disclaimer, the term of this patent is extended or adjusted under 35 U.S.C. 154(b) by 339 days.

(21) Appl. No.: 16/278,715

(22) Filed: Feb. 19, 2019

(65) Prior Publication Data

US 2020/0229564 A1 Jul. 23, 2020

Related U.S. Application Data

(63) Continuation-in-part of application No. 16/257,044, filed on Jan. 24, 2019, which is a continuation-in-part of application No. 16/252,659, filed on Jan. 20, 2019.

(51) Int. Cl.

| | |
|---|---|
| ***A45C 11/00*** | (2006.01) |
| ***A45D 24/08*** | (2006.01) |
| ***A45D 24/10*** | (2006.01) |
| ***A45D 24/36*** | (2006.01) |
| *A45D 24/00* | (2006.01) |

(52) U.S. Cl.

CPC ..... *A45C 11/008* (2013.01); *A45D 24/08* (2013.01); *A45D 24/10* (2013.01); *A45D 24/36* (2013.01); *A45C 2011/007* (2013.01); *A45D 2024/002* (2013.01)

(58) Field of Classification Search

CPC . A45C 11/008; A45C 2011/007; A45D 24/08; A45D 24/10; A45D 24/36; A45D 24/16; A45D 2024/002

USPC ..... D3/205; D28/9

See application file for complete search history.

(56) References Cited

U.S. PATENT DOCUMENTS

| | | | | | |
|---|---|---|---|---|---|
| 1,390,332 | A * | 9/1921 | Bethincourt | A46B 15/0059 | 132/312 |
| 3,620,229 | A * | 11/1971 | Friedman | A45D 24/08 | 132/119 |
| 3,877,472 | A * | 4/1975 | D'Angelo | A45D 24/36 | 132/145 |
| 4,336,815 | A * | 6/1982 | Ross | A45D 24/08 | 132/143 |
| 4,414,991 | A * | 11/1983 | Marcotte | A45D 24/36 | 132/214 |
| 5,152,307 | A * | 10/1992 | Schlaszus | A45C 11/24 | 132/289 |
| 5,320,125 | A * | 6/1994 | Barnhart | A45D 40/18 | 132/297 |
| 6,206,010 | B1 * | 3/2001 | Malki | A45D 24/00 | 132/102 |

(Continued)

*Primary Examiner* — Nicholas D Lucchesi

(57) ABSTRACT

A pocket utility case and travel tool for storing personal care products and having a variety of quickly assembled utility tools for maintaining oral hygiene, personal hygiene and grooming, the pocket utility case and travel tool. The pocket utility case and travel tool having a housing, storage compartments, a comb slot, a detachable lid, the detachable lid includes an adapter head and a handle coupled to the adapter head, a pivoting comb coupled to the handle of the detachable lid at a pivot point, the comb slot configured to receive the pivoting comb when the detachable lid is attached to the housing.

10 Claims, 23 Drawing Sheets

(56) References Cited

U.S. PATENT DOCUMENTS

| | | | | |
|---|---|---|---|---|
| 6,510,856 | B1 * | 1/2003 | Ahn | A41G 5/0086 132/126 |
| 6,588,108 | B2 * | 7/2003 | Talavera | B26B 19/16 30/124 |
| 8,066,014 | B2 * | 11/2011 | Deris | A46B 15/0077 132/102 |
| 2015/0270862 | A1 * | 9/2015 | Harris | A45C 11/008 224/576 |
| 2018/0042358 | A1 * | 2/2018 | Wilson | A45D 24/10 |
| 2018/0289129 | A1 | 10/2018 | Kosmach | |
| 2019/0110577 | A1 * | 4/2019 | Mcdonough | A45C 11/008 |
| 2019/0246764 | A1 * | 8/2019 | Ott | A45D 24/04 |
| 2019/0313762 | A1 * | 10/2019 | Maor | A45D 24/32 |

* cited by examiner

POCKET UTILITY CASE AND TRAVEL TOOL

RELATED APPLICATIONS

This application claims the benefit of priority of U.S. Application Ser. No. filed Ser. No. 16/252,659, filed Jan. 20, 2019 and U.S. Application Ser. No. filed Ser. No. 16/257,044, filed Jan. 24, 2019 which are herein incorporated by reference to the present application.

FIELD OF THE INVENTION

The present invention relates to a pocket utility case and travel tool. Particularly, the pocket utility case and travel tool device includes a portable and multifunctional utility case for storing personal care products while having a variety of quickly assembled utility tools for maintaining oral hygiene, personal hygiene and grooming.

BACKGROUND

Utility cases are bulky, large, and primarily used to store and protect items. Toiletry cases or travel cases are portable zipper type fabric case for storing personal hygiene products while traveling.

One such personal travel and utility case is exemplified by U.S. Patent No. US20180289129A1, incorporated by reference herein in its entirety. This patent application generally teaches a makeup utility case for use by individuals to remove, touchup or reapply makeup, especially around one's eyes, is disclosed.

Though these types of personal utility cases and many like them may have some desirable features, it is still lacking in other areas that may be beneficial to individual requiring additional and diverse features while on the go.

SUMMARY

It is an advantage of the present invention to provide a pocket utility case and travel tool for storing personal care products and having a variety of quickly assembled personal utility tools for maintaining personal hygiene, oral hygiene, and grooming, the pocket utility case and travel tool may include a housing having a top portion, storage compartments, and a comb slot, a detachable lid coupled to the top portion of the housing, the detachable lid includes an adapter head and a handle coupled to the adapter head, the adapter head includes a hemispherical shell having a first adapter port for receiving a detachable dental appliance adapter and a second adapter port for receiving a detachable razor adapter; and a pivoting comb coupled to the handle of the detachable lid at a pivot point, the comb slot is configured to receive the pivoting comb when the detachable lid is attached to the housing.

In one embodiment, a brush assembly may be coupled to a bottom portion of the housing. In another embodiment, the brush assembly is magnetically coupled to the bottom portion of the housing. In yet another embodiment, the hemispherical shell includes a third adapter port for receiving an LED light component. It still yet another embodiment, the pivoting comb has a maximum rotation of approximately 90 degrees about the pivot point.

In one aspect, the first adapter port may be positioned to run parallel to a lengthwise midsection of the handle. In another aspect, the second adapter port positioned at an angle of approximately 40-50 degrees formed between a lengthwise midsection of the handle and the second adapter port.

In one implementation, the detachable dental appliance adapter may include a dental connecting shaft for receiving a dental appliance at a dental receiving end of the dental connecting shaft, a dental appliance base coupled to the dental connecting shaft for providing support to the dental connecting shaft, and a dental appliance fastener coupled to the dental connecting shaft for connecting the detachable dental appliance adapter to the first adapter port. In another implementation, the detachable razor adapter includes a razor bracket for receiving a razor head at a razor receiving end of the razor bracket, a razor base coupled to the razor bracket for providing support to the razor bracket, and a razor fastener coupled to the razor bracket for connecting the detachable razor adapter to the second adapter port. In yet another implementation, the housing includes a panel frame for supporting a mirror or optical panel. In still yet another implementation, the optical panel may be a solar panel.

In another embodiment, the housing may include a battery coupled to the solar panel and a USB port for delivering power to an external device.

In one example, a template and guide insert slot may be formed along a top portion of the pivoting comb having a narrow slot for receiving a hair styling template and guide. In another example, the storage compartments may include at least two tube storage areas, at least two rectangular storage areas, and a guide slot compartment for storing the hair styling template and guide. In yet another example, the guide slot compartment may be formed on a lower side portion of the housing for storing the hair styling template and guide.

Some advantages of the pocket utility case and travel tool include 1} compact and portable (i.e., travel size, carry in pockets of pants, shirts, sweaters, backpacks); 2) mobile and streamline features; 3) diverse and interchangeable set of personal products and personal care tools; 4) light-weight; and 5) space-savings.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, one or more elements may have the same reference numeral in different figures indicating previously described elements.

DETAILED DESCRIPTION

Embodiments in this disclosure include a novel pocket utility case and travel tool for storing personal care products and having a variety of utility tools maintaining oral hygiene, personal hygiene and grooming.

Unlike the conventional utility cases and travel cases available on the market which typically include small bags or storage containers storing an assortment of personal items like brushes, combs, shaving products, dental products, hair sprays, and hair gel as separate items, the novel pocket utility case and travel tool includes a unified, simple, portable, multipurpose, and versatile device, making it less expensive and simple to manufacture, and advantageous and a key distinction over conventional utility cases. In the examples presented below, the novel pocket utility case and travel tool includes quickly assembled personal utility tools and is generally applicable to oral hygiene, personal hygiene and grooming while on the go.

Figure 1B:
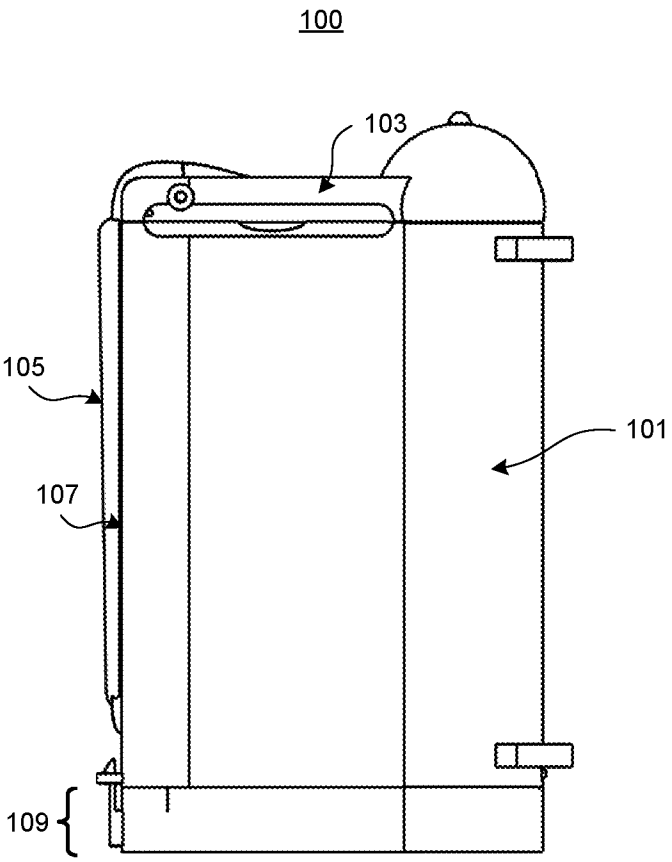
FIG. 1A and FIG. 1B illustrate a front view and a back view, respectively, of a pocket utility case and travel tool in accordance to an embodiment.
Figure 1A:
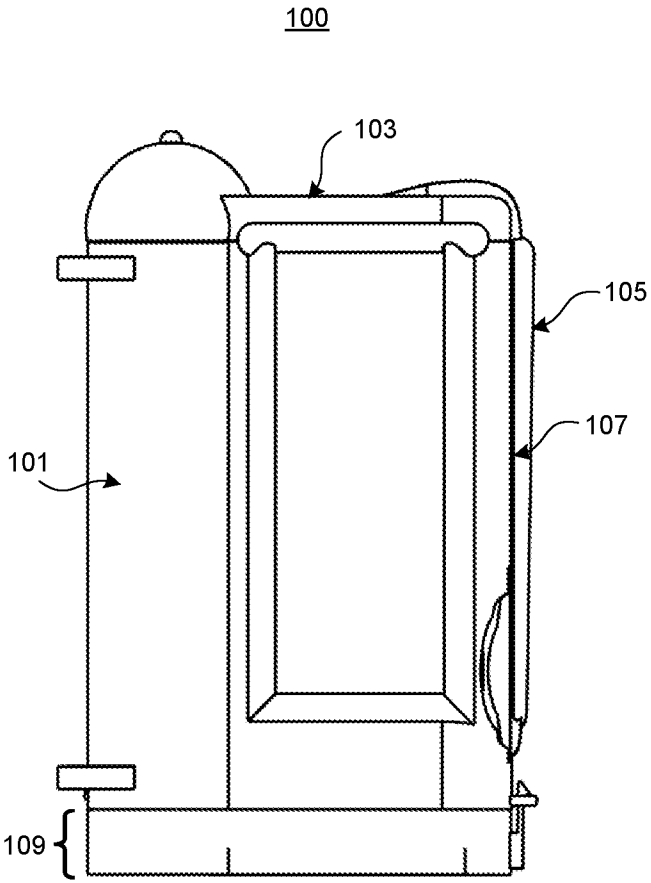

FIG. 1A and FIG. 1B illustrate a front view and a back view, respectively, of a pocket utility case and travel tool 100 for storing personal care products and having a variety of utility tools for maintaining oral hygiene, personal hygiene and grooming according to an embodiment. The pocket utility case and travel tool 100 includes a housing 101, a detachable lid 103 (or top cover) coupled to a top portion of the housing 101, a pivoting comb 105 coupled to the detachable lid 103 and configured to fit into a comb holder slot 107 formed in the housing 101 when the detachable lid 103 is attached to the housing 101. Optionally, a detachable brush assembly 109 may be coupled to a bottom portion of the housing 101.

Figure 2:
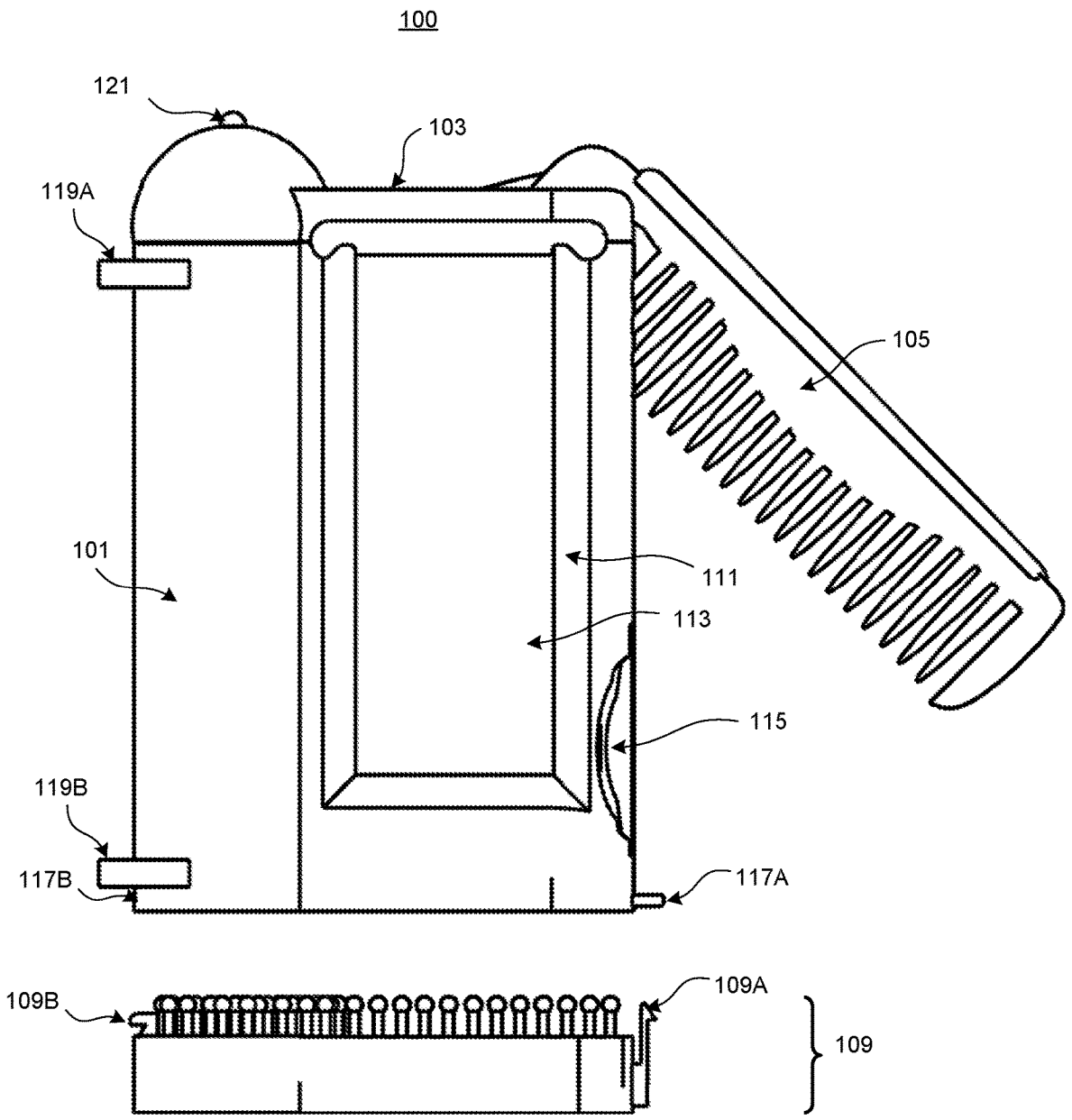
FIG. 2 illustrates a front of the pocket utility case and travel tool with the pivoting comb being partially exposed from the case and the detachable brush assembly removed from the bottom of the case, according to an embodiment.

FIG. 2 illustrates a front of the pocket utility case and travel tool 100 with the pivoting comb 105 being partially exposed from the housing 101 and the detachable brush assembly 109 removed from the bottom of the housing 101, according to an embodiment. Additional components of the housing 101 may include, for example, a panel frame 111 for supporting a mirror or optical panel 113, a guide slot 115 for storing hair styling template and guide, and a brush clip catches (117A, 117B) providing quick release fasteners to corresponding latches (109A, 109B) that may be coupled to the brush assembly 109. In another implementation, the housing 101 and the brush assembly 109 may be magnetically coupled using a magnet and magnetic plate. Also shown are strap clips (119A, 119B) for attaching an optional carrying strap (not shown). In addition, an optional personal LED light 121 may be coupled to a dome section of the lid 103.

Figure 3:
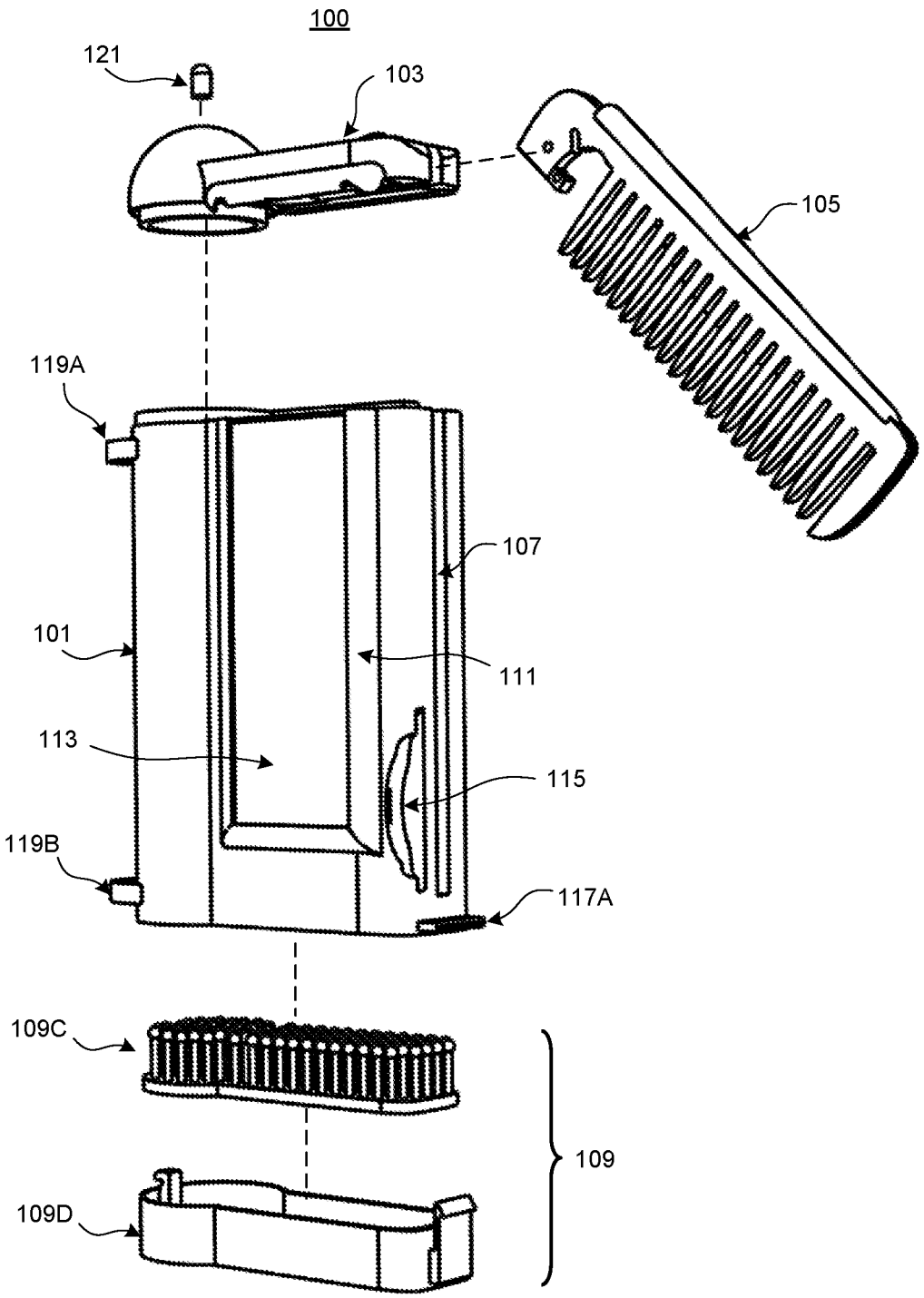
FIG. 3 illustrates a front perspective and exploded view of the pocket utility case and travel tool according to an embodiment.

FIG. 3 illustrates a front perspective and exploded view of the pocket utility case and travel tool 100 according to an embodiment. Many individual components are depicted in this disassembled state including the detachable lid 103, the optional personal LED light 121, the pivoting comb 105 the housing 101, and brush assembly 109. Also revealed in the disassembly are individual components of the brush assembly 109, including a brush bristle member 109C and brush handle member 109D.

Figure 4A:
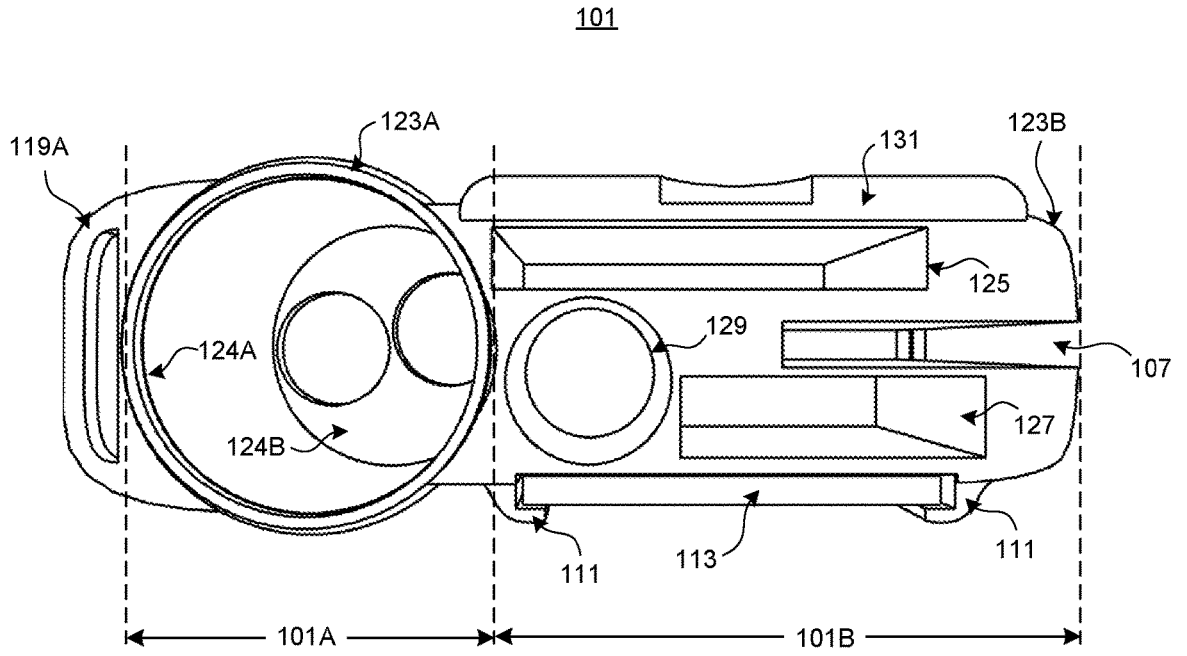
FIG. 4A-FIG. 4B illustrate a top and bottom view, respectively, of the housing, according to an embodiment.
Figure 4B:
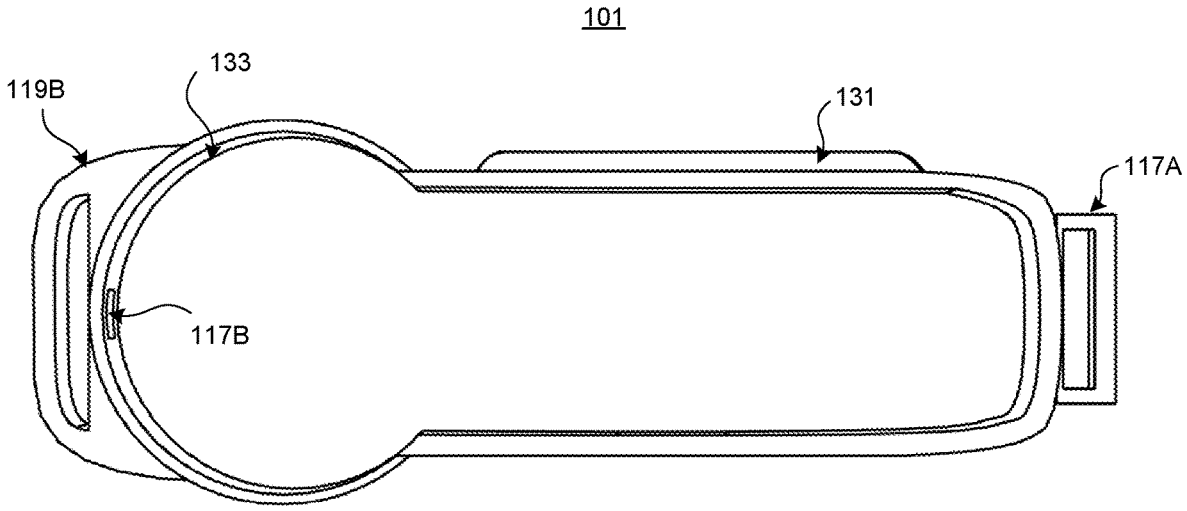

FIG. 4A-FIG. 4B illustrate a top and bottom view, respectively, of the housing 101, according to an embodiment. The housing 101 is a storage container having many compartments of varying shapes for storing different types of personal items. In FIG. 4A, for example, the housing 101 may include a round tube-shaped storage area 123A formed on a first end 101A of the housing 101 and a secondary storage area 123B formed on a second end 101B of the housing 101. The tube-shaped storage area 123A is generally cylindrical in shape having an opening 124A formed on a top end of the tube-shaped storage area 123A and a closed end 124B formed at a bottom end of the tube-shaped storage area 123A. The tube-shaped storage area 123A may be slightly projected to form a circular lip at the top end of the tube-shaped storage area 123A to provide support and secure the detachable lid 103 the housing 101 when attached. In the secondary storage area 123B other separate compartments may include two rectangular containers (125, 127) and a smaller tube-shaped container 129. An optional support ledge 131 may be coupled to one side of the housing 101 providing additional support the detachable lid 103 when attached. In FIG. 4B, a brush compartment 133 is formed along the bottom portion of the housing 101 having a container sufficient in height and shape to fully contain the brush assembly 109 when inserted and attached to the bottom of the housing 101. In practice, the tube-shaped storage area 123A has a circular radius of approximately 20 mm and a height of about 135 mm while the secondary storage area 123B is approximately 60 mm (W)×30 mm (D)×135 mm (H).

Figure 5B:
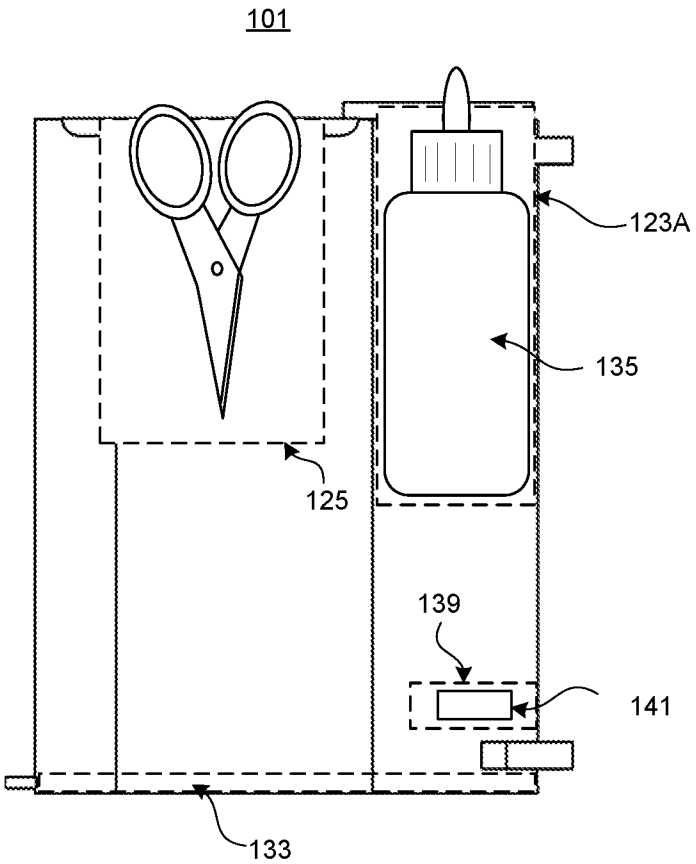
FIG. 5A and FIG. 5B illustrate a front side view and a back side view, respectively, of the housing, according to an embodiment.
Figure 5A:
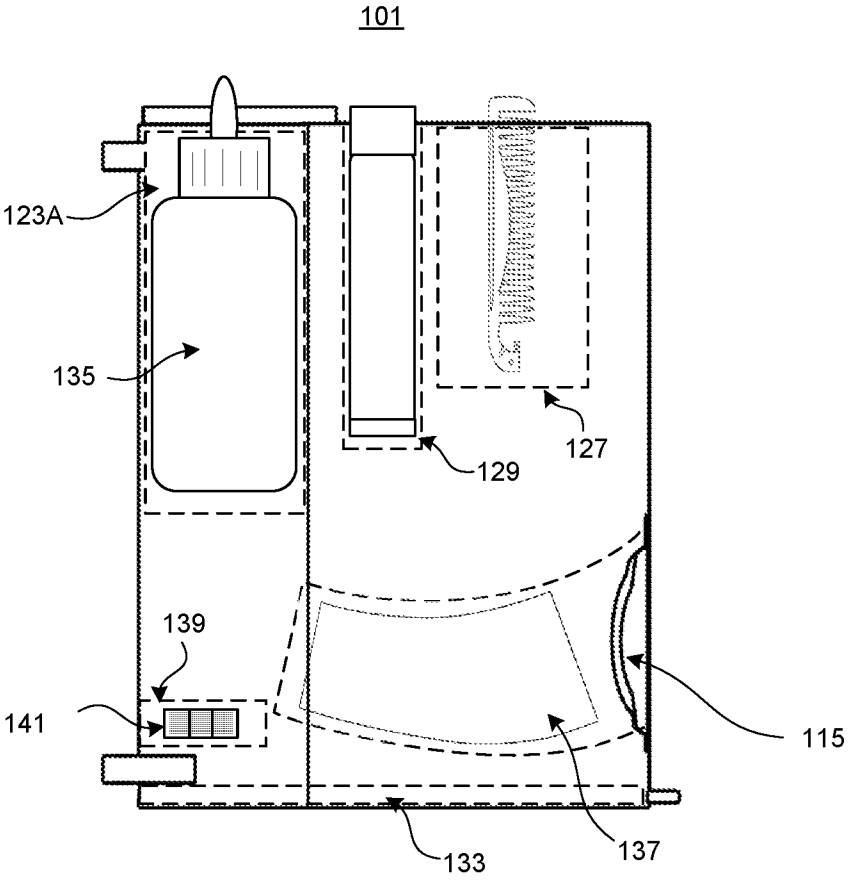

FIG. 5A and FIG. 5B illustrate a front side view and a back side view, respectively, of the housing 101, according to an embodiment. Various personal items may be stored in the available compartments of the housing 101. For example, a 1-2 ounce bottle 135 of beard oil, hair spray, hair gel, toothpaste, or mouthwash may be stored in the tube-shaped storage area 123A as shown FIG. 5A and FIG. 5B. In addition, the two rectangular containers (125, 127) may be configured to store a moustache comb, toothbrush head, small scissors, nail filer, nail clipper, a battery, dental appliance adapter, or razor adapter while the smaller tube-shaped container 129 may store personal items such as a beard stick, lip balm container, or lip stick. The housing 101 may also include the guide slot 115 for storing template and guide 137. In yet another implementation, the housing 101 may also include spool container 139 for storing and dispensing string 141 including, for example, dental floss. The individual compartments (115, 123A, 125, 127, 129, 139) in the housing 101 may be customized to store other personal travel items including, for example, a combination of first aid supplies, hand sanitizers, hand wipes, hand cleaners, lotions, body powders, deodorants, mouthwash, cotton swabs, vitamins, pills, drug testing supplies, perfumes, colognes, smoking pipes, grinders, cleaning tools, eardrops, nose drops, and eye drops.

Figure 6A:
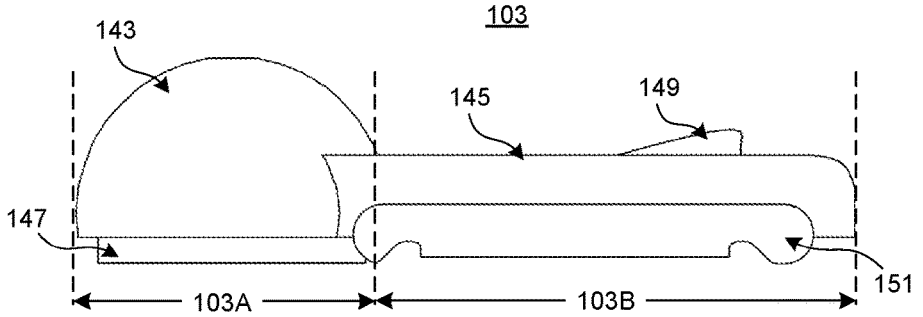
FIG. 6A-FIG. 6D illustrate a front side, top side, backside, and bottom side views, respectively, of the detachable lid, according to an embodiment.

FIG. 6A-FIG. 6D illustrate a front side, top side, backside, and bottom side views, respectively, of the detachable lid 103, according to an embodiment. The detachable lid 103 includes a first lid member 103A comprising of an adapter head 143 and a second lid member 103B comprising a handle 145 coupled to the adapter head 143. As shown in FIG. 6A, the adapter head 143 includes a hemispherical shell and is adapted to fit into the top portion of the tube-shaped storage area 123A when the detachable lid 103 is attached the housing 101. An interlocking lip 147 formed at a bottom portion of the adapter head 143 is configured to mate and secure with the top portion of the tube-shaped storage area 123A when the detachable lid 103 is attached the housing 101. Additional components in the second lid member 103B include 1) a comb stop member 149 coupled near a comb pivoting end (at an opposite end of the adapter head 143) of the handle 145 for preventing the pivoting comb 105 from being rotated beyond a top portion of the handle 145; and 2) a panel frame cap 151 coupled to a front side portion of the handle 145 for securing the mirror or optical panel 113 to the housing 101 when the detachable lid 103 is attached.

Figure 6B:
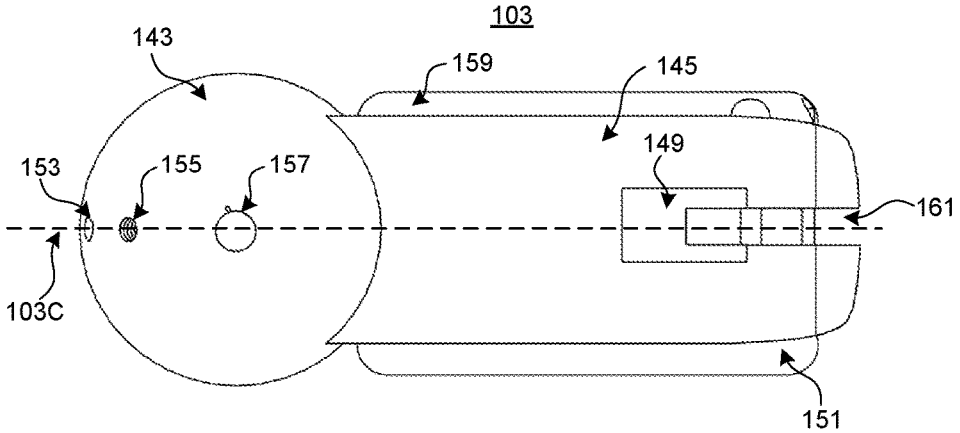

Other components of the detachable lid 103 are revealed in the top side view as shown FIG. 6B. These components include, for example, a first adapter port 153 positioned along a lengthwise mid-section 103C of the lid detachable 103 near a lower portion of the adapter head 143, a second adapter port 155 positioned along the lengthwise mid-section 103C of the detachable lid 103 above the second adapter port 155, and an optional LED port 157 positioned along the lengthwise mid-section 103C of the detachable lid 103 near a top center portion of the adapter head 143. The detachable lid 103 may also include an optional lid ledge 159 formed on the back side portion of the handle 145. Functionally, the optional lid ledge 159 may rest on the support ledge 131 of the housing 101, providing additional support to the detachable lid 103 when attached to the housing 101. Also shown and included is a lid comb slot 161 which is formed at the comb pivoting end of the handle 145 opposite to the adapter head 143. The lid comb slot 161 provides a channel into which the comb is guided when attached to the detachable lid 103.

Figure 6C:
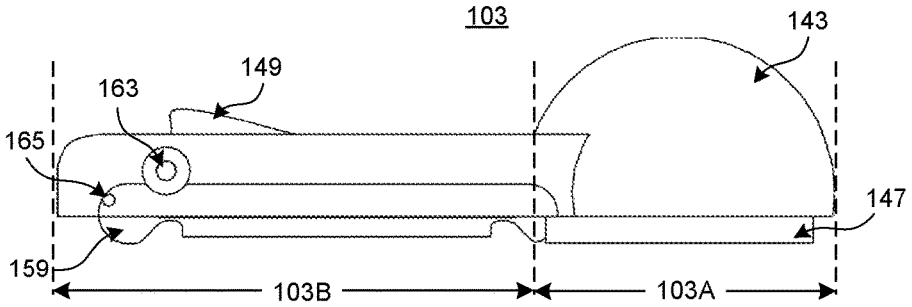

Referring to FIG. 6C, a lid-comb fastener and pivot slot 163 and lid-comb catch pin slot 165 are formed near the end portion of the handle 145. In operation, the lid-comb fastener and pivot slot 163 provides an opening in the handle 145 to insert a fastener (not shown) to secure the pivoting comb 105 to the handle 145 while the lid-comb catch pin slot 165 provides another opening in the handle 145 to insert a comb catch pin (not shown) for preventing the pivoting comb 105 from being rotated and extended above the handle 143.

Figure 6D:
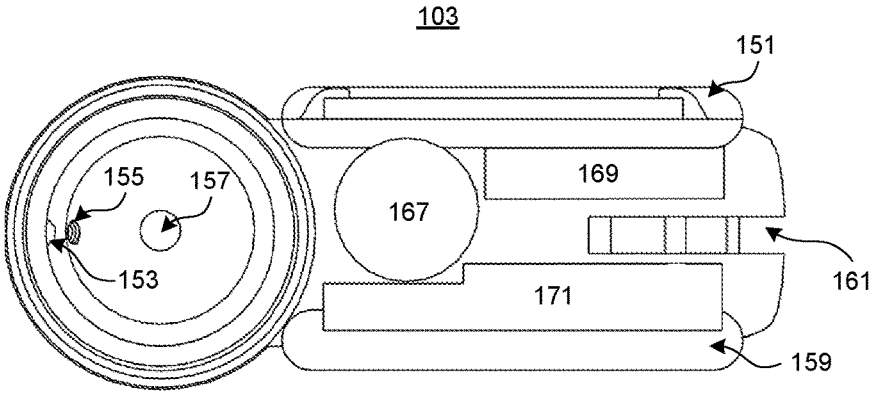

In FIG. 6D, multiple shallow lid chambers are formed in a bottom portion of the second lid member 1033. These multiple shallow chambers may include 1) a circular lid chamber 167 corresponding and aligned to the smaller tube-shaped container 129 of the housing 101 when the detachable lid 103 is attached to the housing 101; 2) a first rectangular lid chamber 167 corresponding and aligned to the one of the rectangular containers 127 of the housing 101 when the detachable lid 103 is attached to the housing 101; and 3) a second rectangular lid chamber 171 corresponding and aligned to the other the rectangular container 125 of the housing 101 when the detachable lid 103 is attached to the housing 101.

Figure 7:
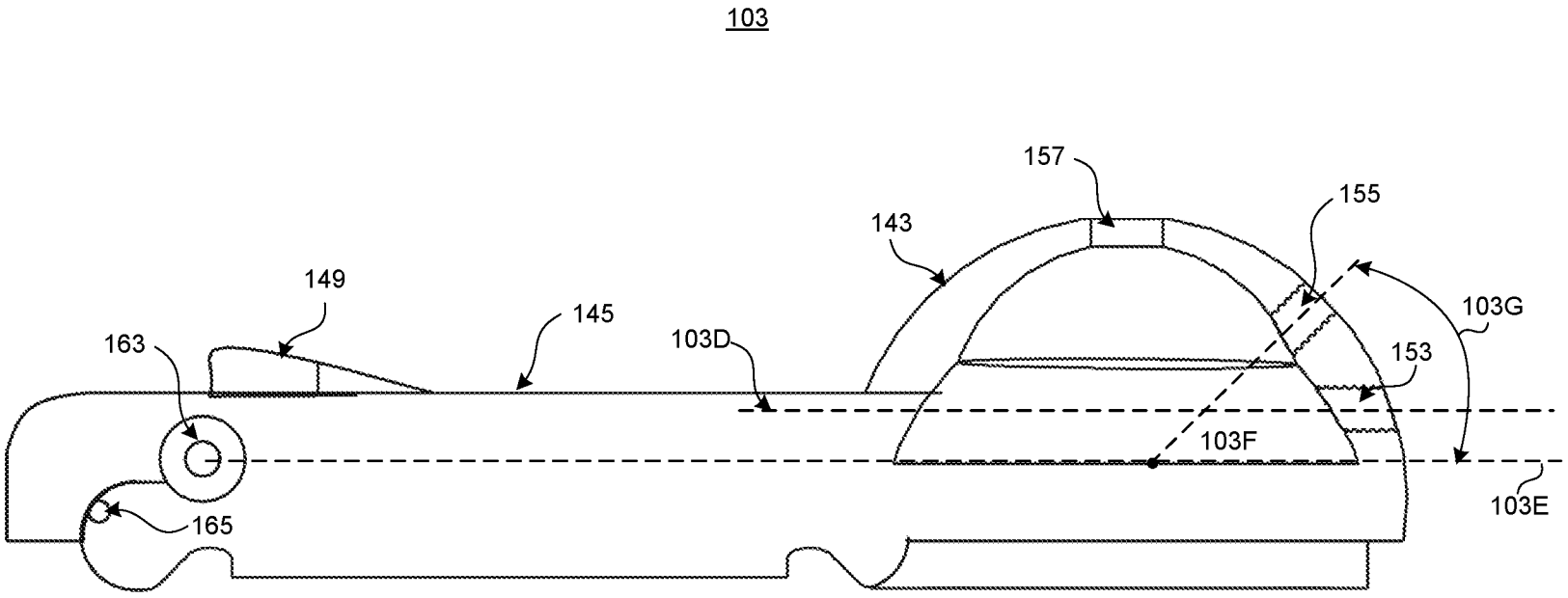
FIG. 7 illustrates a back side view of the detachable lid 103 according to an embodiment.

FIG. 7 illustrates a back side view of the detachable lid 103, according to an embodiment. In this embodiment, specific angular placements of the first adapter port 153 and second adapter port 155 relative to the adapter head 143 and the handle 145 are provided. In one implementation, the placement of the first adapter port 153 along line 103D is configured to run parallel to a lengthwise midsection 103E of the handle 145. In another implementation, the second adapter port 155 is positioned along line 103F having an angle 103G of approximately 40-50 degrees formed between the lengthwise midsection 103E of the handle 145 and the second adapter port 155. Relative to the hemispherical shape of the adapter head 143, the second adapter port is positioned at the angle 103G of approximately 40-50 degrees of the hemispherical shell. These placements are based on specific usage of the adapter head 143 of the detachable lid 103 for different applications. For example, the placement of the first adapter port 153 running parallel to the adapter head 143 is necessary for certain applications such as when the neck of a toothbrush is mounted to the adapter head 143 while the placement of the second adapter port 155 at a 40-50 degree angle relative to the handle 145 is necessary for other applications such as when a razor head is mounted to the adapter head 143.

Figure 8A:
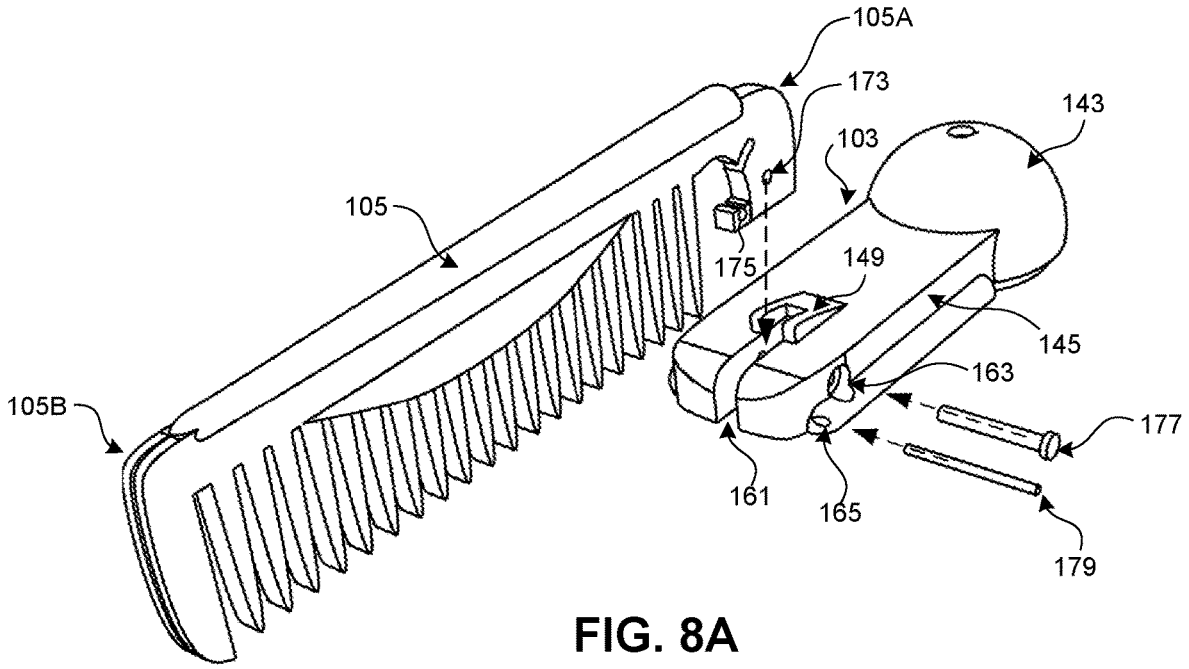
FIG. 8A and FIG. 8B illustrate top exploded view of the pivoting comb detached from the detachable lid, and a top perspective view of the pivoting comb attached to the detachable lid, respectively, according to an embodiment.
Figure 8B:
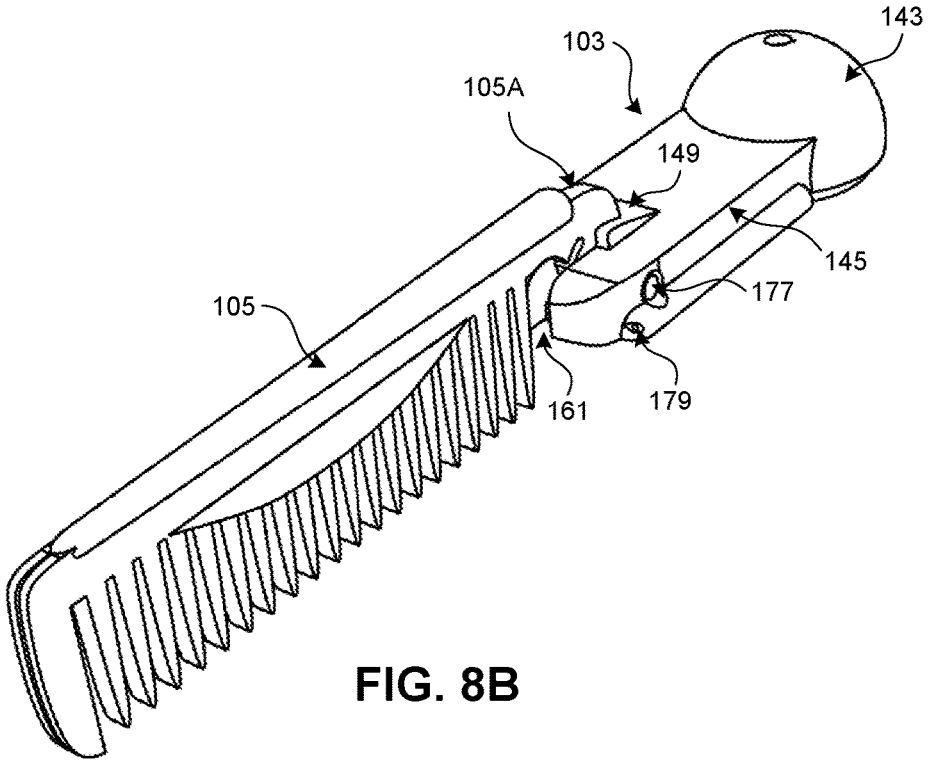

FIG. 8A and FIG. 8B illustrate top exploded view of the pivoting comb 105 detached from the detachable lid 103, and a top perspective view of the pivoting comb 105 attached to the detachable lid 103, respectively, according to an embodiment. In FIG. 8A, certain elements of the detached pivoting comb 105 are shown including a comb fastener and pivot slot 173 and comb catch pin slot 175 which are both formed at a comb pivoting end 105A of the pivoting comb 105. Also shown are 1) a comb pivot pin and fastener 177 inserted into the lid-comb fastener pivot slot 163 through the comb fastener and pivot slot 173 for securing the pivoting comb 105 to the detachable lid 103 when attached; and 2) a comb catch pin 179 inserted into the lid-comb catch pin slot 165 through the comb catch pin slot 175 for preventing the pivoting comb 105 from being extended above the handle 145 when rotated. In FIG. 8B, the comb pivoting end 105A of the pivoting comb 105 is inserted through the lid comb slot 161 of the handle 145 when the pivoting comb 105 is attached to the detachable lid 103. Functionally, the comb pivot pin and fastener 177 provides a central pivot point on which the pivoting comb 105 rotates.

Figure 9A:
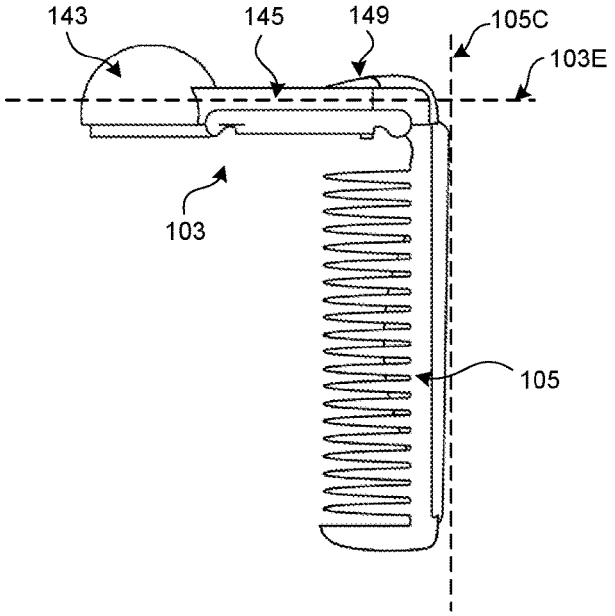
FIG. 9A-FIG. 9C illustrate various rotated positions of the pivoting comb relative to the detachable lid, according to an embodiment.
Figure 9B:
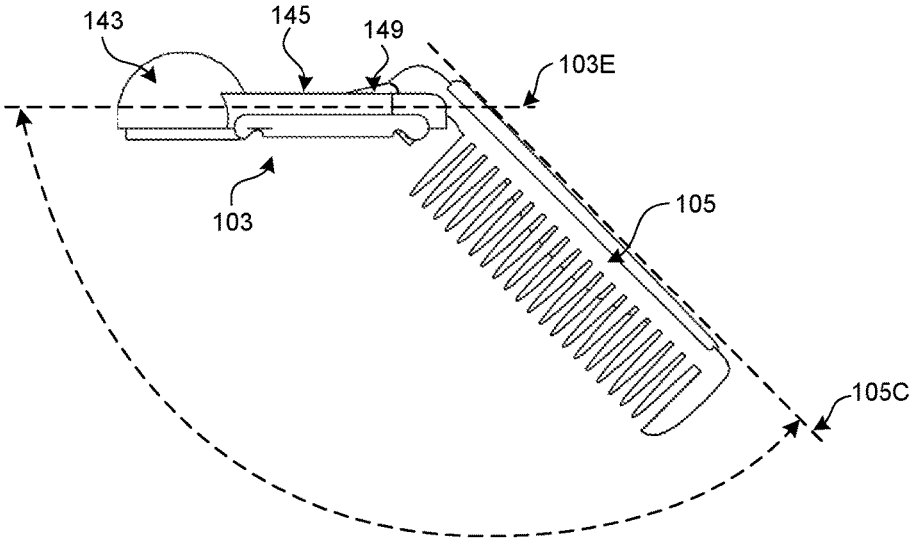
Figure 9C:
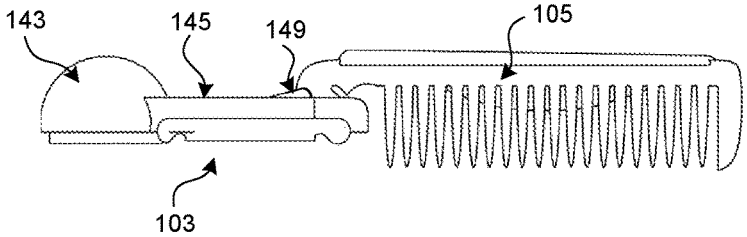

FIG. 9A-FIG. 9C illustrate various rotated positions of the pivoting comb 105 relative to the detachable lid 103, according to an embodiment. FIG. 9A, for example, shows a closed position with a lengthwise edge 105C of the pivoting comb 105 rotated at an angle of approximately 90 degrees relative to the lengthwise midsection 103E of the handle 145. FIG. 9B shows a partially opened position with a lengthwise edge 105C of the pivoting comb 105 rotated at an angle of approximately between 91-179 degrees relative to the lengthwise midsection 103E of the handle 145. FIG. 9C shows a fully opened position with a lengthwise edge 105C of the pivoting comb 105 running parallel to the lengthwise midsection 103E of the handle 145. Also shown in FIG. 9A-9C is the comb stop member 149 for preventing the pivoting comb 105 from being rotated beyond and above the handle 145. Overall, the pivoting comb 105 may be rotated at a maximum of approximately 90 degrees about the pivot point 177 (90 degree=closed position; 180 degrees=open position).

Figure 10A:
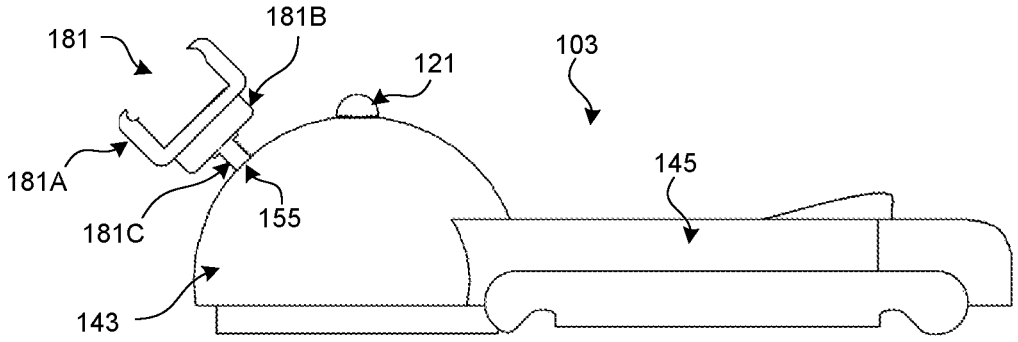
FIG. 10A-FIG. 10C illustrate an example of a razor adapter and razor head attached to the detachable lid, according to an embodiment.
Figure 10B:
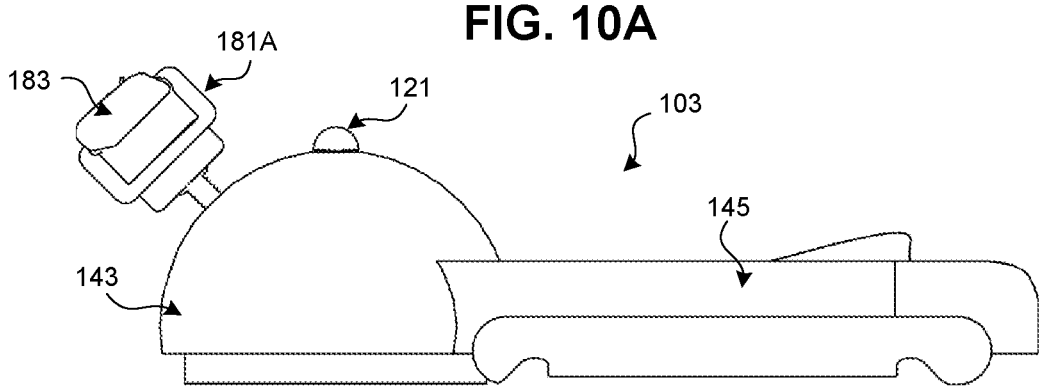
Figure 10C:
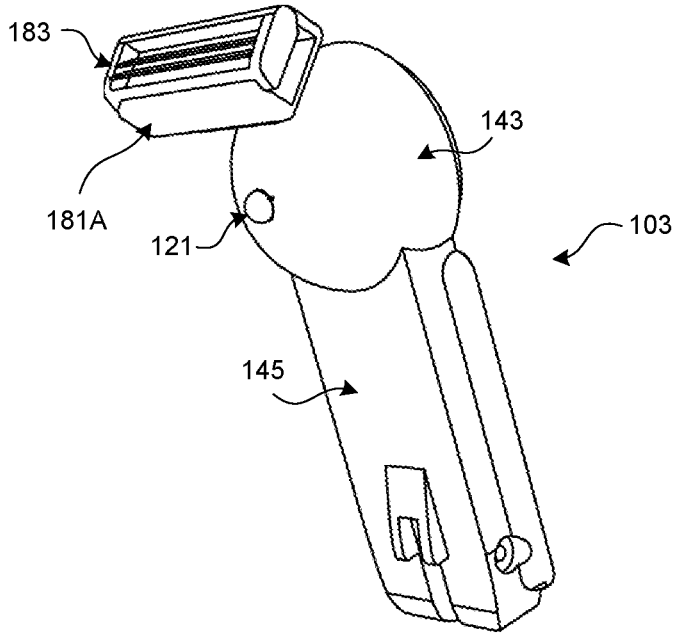

FIG. 10A-FIG. 10C illustrate an example of a razor adapter and razor head attached to the detachable lid 103, according to an embodiment. In FIG. 10A, the second adapter port 155 of the detachable lid 103 may receive a razor adapter 181. Functionally, the razor adapter 181 is made to be easily detachable from the adapter head 143 and stored in one of the compartments in the housing 101. The razor adapter 181 having a razor bracket 181A for receiving a razor head 183 at a razor receiving end of the razor bracket 181A, a razor base 181B coupled to the razor bracket 181A for providing support to the razor bracket 181A, and a razor fastener 181C coupled to the razor bracket 181A for connecting the razor adapter 181 to the second adapter port 155 of the adapter head 143 which is part of the detachable lid 103. In FIG. 10B, the razor head 183 may be inserted into the razor receiving end by sliding a top and bottom portion of the razor head 183 into razor channels formed inside the razor bracket 181A, securing the razor head into the razor bracket 181A. FIG. 10C illustrates a quickly assembled razor blade including handle 145 for personal shaving use. In practice, the quickly assembled razor blade provides a user the equivalent of a full size razor assembly while the optional personal LED light 121 may provide the user the convenience of direct lighting to the shaving area in low lighting situations.

Figure 11A:
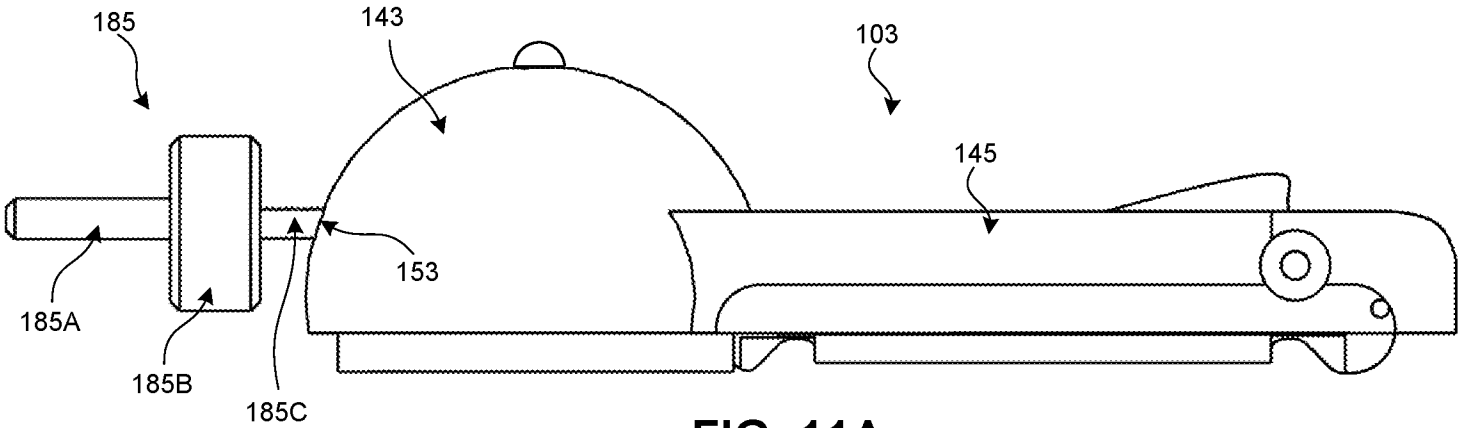
FIG. 11A and FIG. 11B illustrate an example of a dental appliance adapter and toothbrush attached to the detachable lid, according to an embodiment.
Figure 11B:
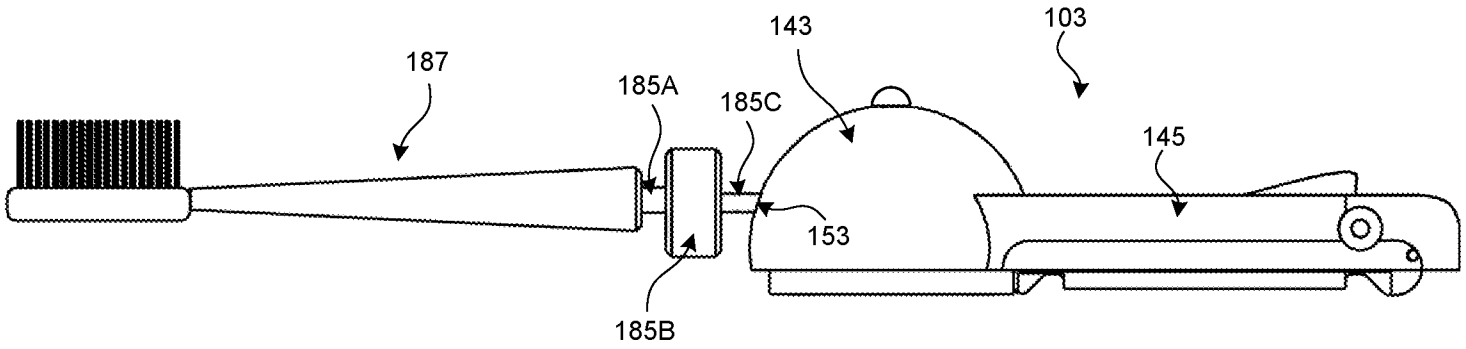

FIG. 11A and FIG. 11B illustrate an example of a dental appliance adapter and toothbrush attached to the detachable lid 103, according to an embodiment. In FIG. 11A, the first adapter port 153 of the detachable lid 103 may receive a dental appliance adapter 185. Functionally, the dental appliance adapter 185 is made to be easily detachable from the adapter head 143 and stored in one of the compartments in the housing 101. The dental appliance adapter 185 having a dental connecting shaft 185A for receiving a dental appliance 187 at a dental receiving end of the dental connecting shaft 185A, a dental appliance base 185B coupled to the dental connecting shaft 185A for providing support to the dental connecting shaft 185A, and a dental appliance fastener 185C coupled to the dental connecting shaft 185A for connecting the dental appliance 187 to the first adapter port 153 of the adapter head 143 which is part of the detachable lid 103. In FIG. 11B, the dental appliance 187 (e.g., a head and neck of a toothbrush) having a support cavity at a distal end opposite to the brush end of the dental appliance 187 may be inserted into the dental connecting shaft 185A, securing the dental appliance 187 to the adapter head 143 of the detachable lid 103 and providing a quickly assembled dental appliance (i.e., toothbrush) including the handle 145 for personal oral use. In practice, the quickly assembled dental appliance provides a user the equivalent of a full size toothbrush assembly while the optional personal LED light 121 may provide the user the convenience of direct lighting to the shaving area in low lighting situations.

Figure 12A:
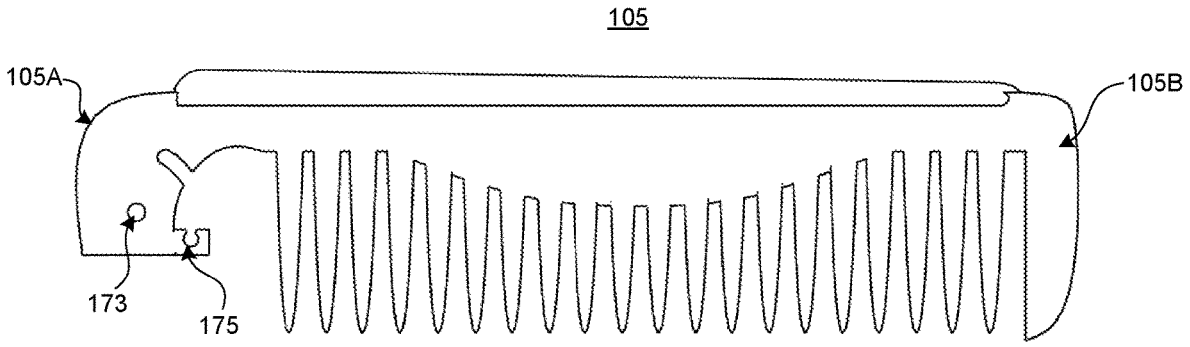
FIG. 12A and FIG. 12B illustrate a side and a front perspective view of the pivoting comb, according to an embodiment.
Figure 12B:
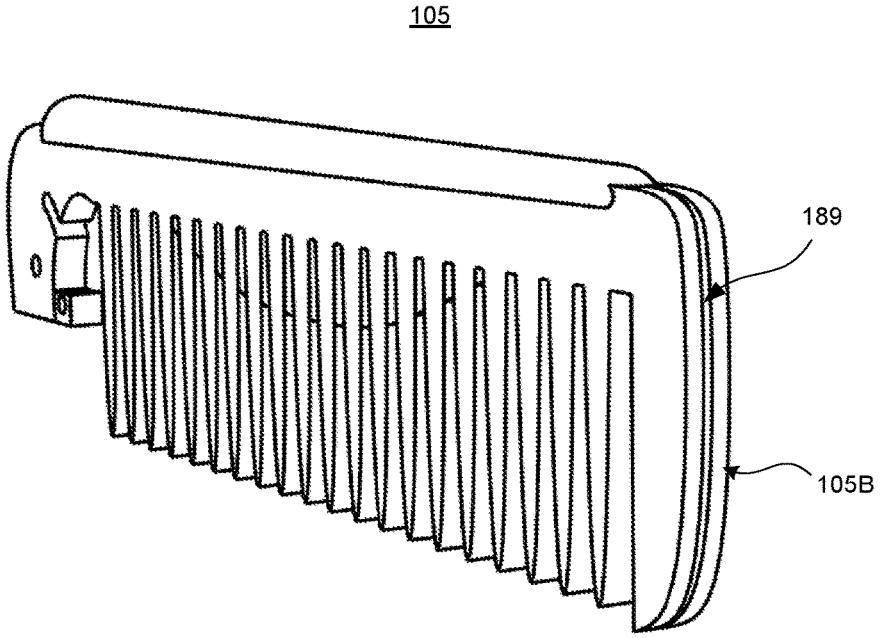

FIG. 12A and FIG. 12B illustrate a side and a front perspective view of the pivoting comb 105, according to an embodiment. In addition to the pivoting components (173, 175) of the pivoting comb 105, a template and guide insert slot 189 may be formed along a top comb end 105B opposite to the comb pivoting end 105A of the pivoting comb 105. The template and guide insert slot 189 is configured to have a narrow slot for receiving the template and guide 137 as describe in the following section.

Figure 13:
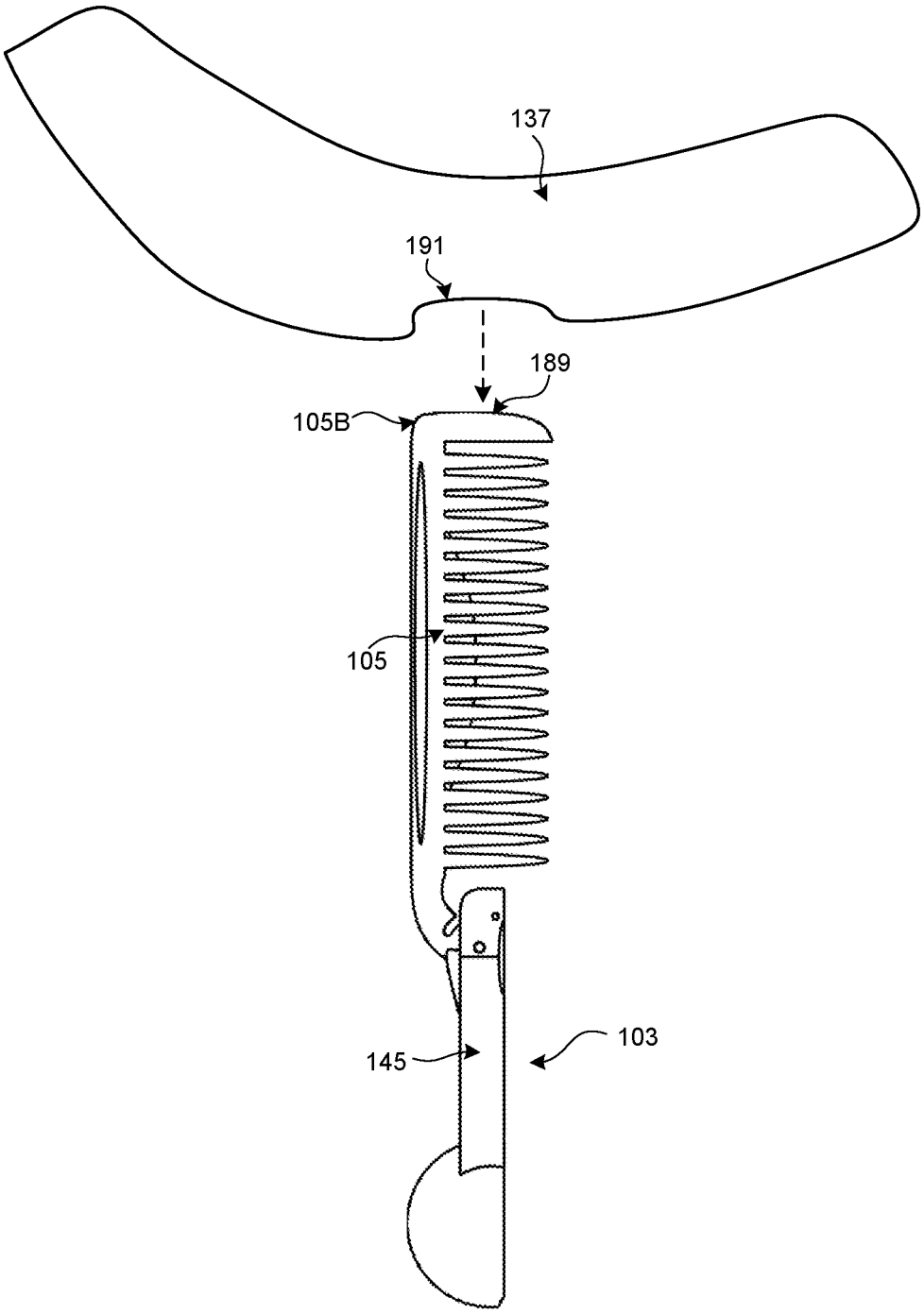
FIG. 13 illustrates an application of the pivoting comb and the dental or template and guide according to an embodiment.

FIG. 13 illustrates an application of the pivoting comb 105 and the dental or template and guide 137 according to an embodiment. In one implementation, the template and guide 137 is generally a thin and narrow strip yet sturdy material that includes a guide slot 191 centrally position along a bottom portion of the template and guide 137 as shown in FIG. 13. In general, the guide slot 191 is complementary in shape to the top comb end 105B into which the guide slot 191 is inserted.

Figure 14:
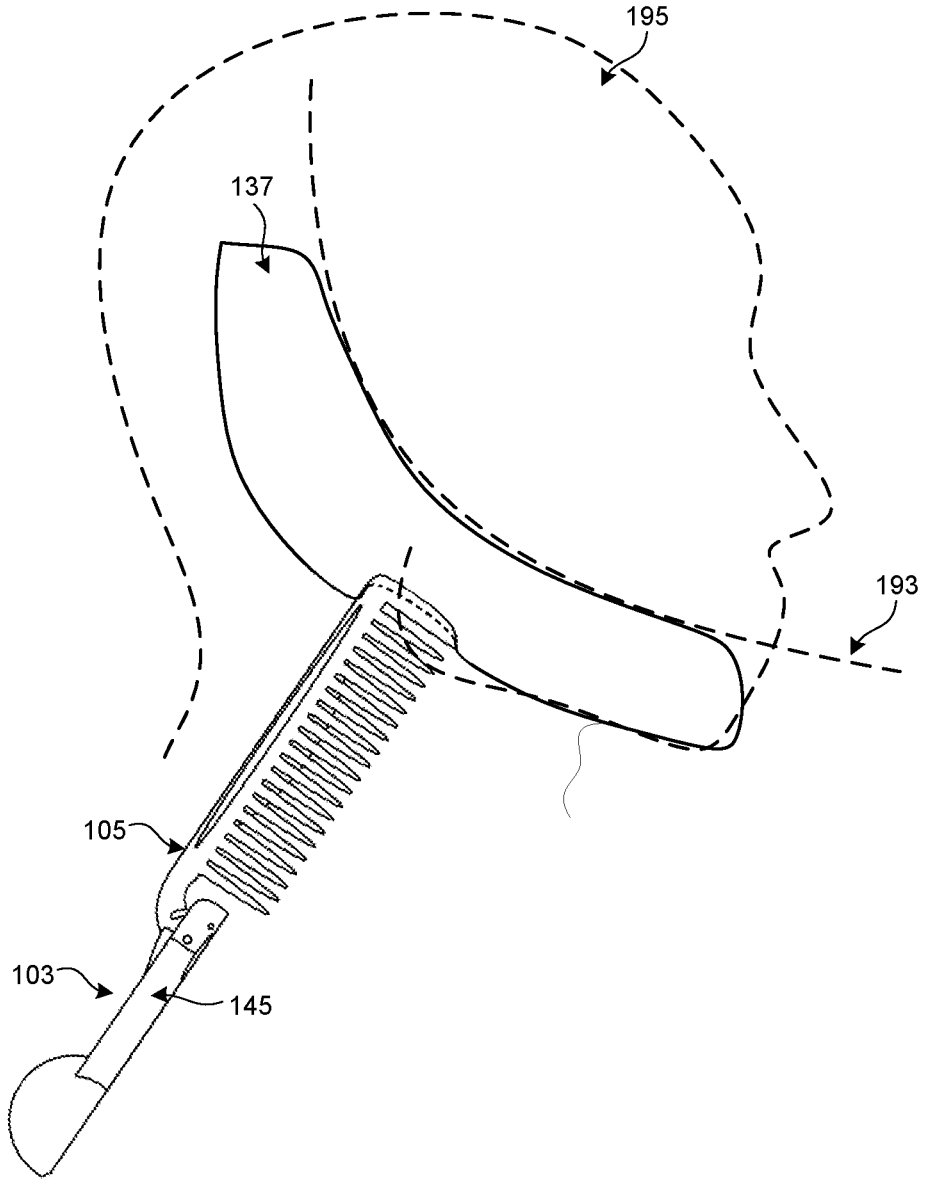
FIG. 14 illustrates a typical use of the template and guide according to an embodiment.

FIG. 14 illustrates a typical use of the template and guide 137 according to an embodiment. In one application, the template and guide 137 may be in the form of a beard styling template having a curved shape that generally follows a beard path 193 along the face of the user 195. In practice, the beard styling template may be applied to the cheek of the user 195 between the ear and chin. Using the handle 145 and with the template and guide 137 attached to the pivoting comb 105, the user may apply the beard styling template to rest firmly against the cheek, shaping the beard with a razor blade or scissor to follow the pattern along the beard path 193 of the beard styling template.

Figure 15A:
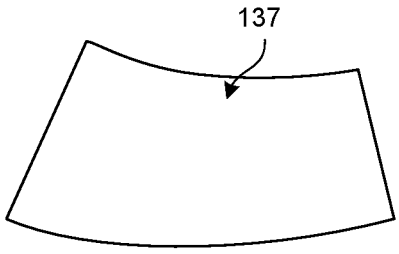
FIG. 15A-FIG. 15C illustrate an example of unfolding the template and guide from a compact state to an unfolded state, according to an embodiment.
Figure 15B:
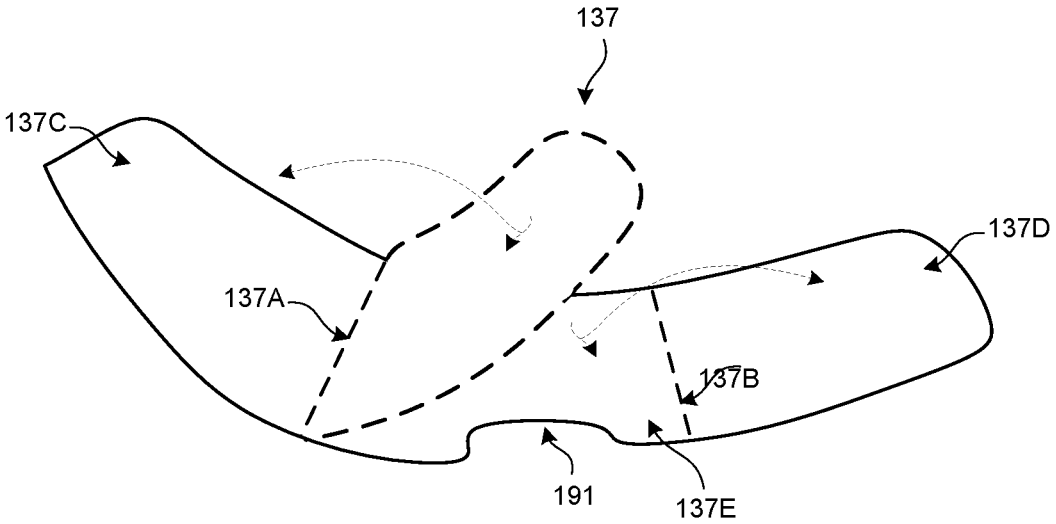
Figure 15C:
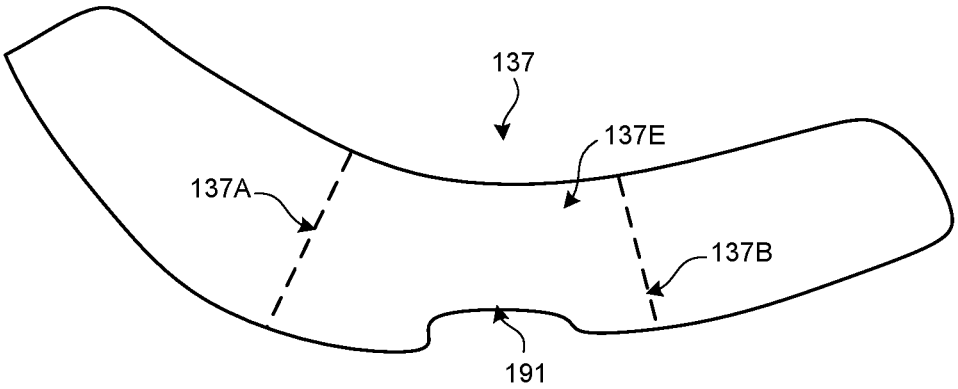

FIG. 15A-FIG. 15C illustrate an example of unfolding the template and guide 137 from a compact state to an unfolded state, according to an embodiment. In FIG. 15A, the template and guide 137 is in its compacted state, allowing it to be fitted and stored into the guide slot 115 of the housing 101. FIG. 15B illustrate fold lines (137A, 137B) from which the template and guide 137 is unfolded at each fold wing (137C, 137D) away from a central guide member 137E of the template and guide 137. FIG. 15C illustrate the template and guide 137 completely unfolded, flattened, and ready to use by the user. In practice, template and guide 137 be made from materials such as paper, plastic, metal and wood. Optionally, the fold wings (137C, 137D) may be attached to the central guide member 137E by hinges along the fold seams (137A, 137B).

Figure 16A:
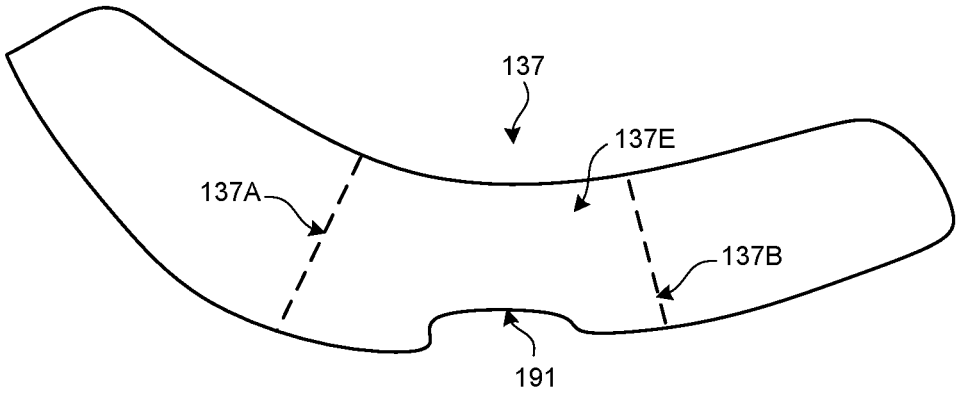
FIG. 16A-FIG. 16C illustrate an example of folding the template and guide back to its compact size, according to an embodiment.
Figure 16B:
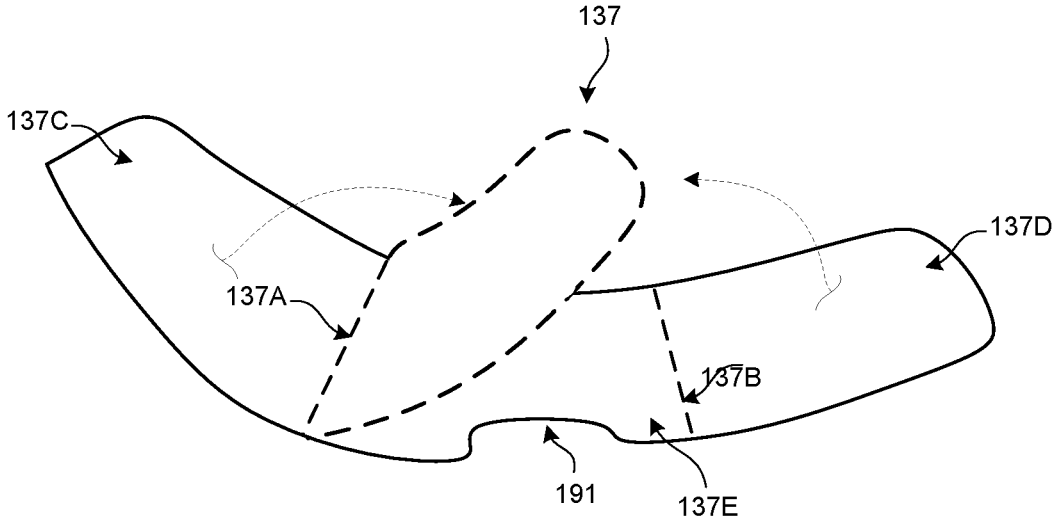
Figure 16C:
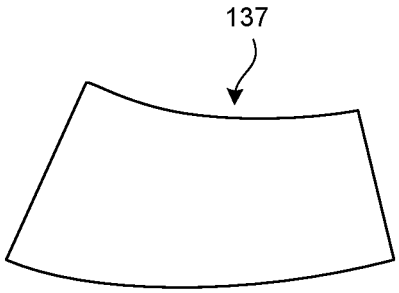

FIG. 16A-FIG. 16C illustrate an example of folding the template and guide 137 back to its compact size, according to an embodiment. In FIG. 16A, the template and guide 137 is in its unfolded flattened state, having fold lines (137A, 137B). FIG. 15B illustrate folding each fold wing (137C, 137D) towards the central guide member 137E along fold lines (137A, 137B) of the template and guide 137. FIG. 15C illustrate the template and guide 137 completely folded, flattened, and ready to be fitted and stored into the guide slot 115 of the housing 101.

Figure 17B:
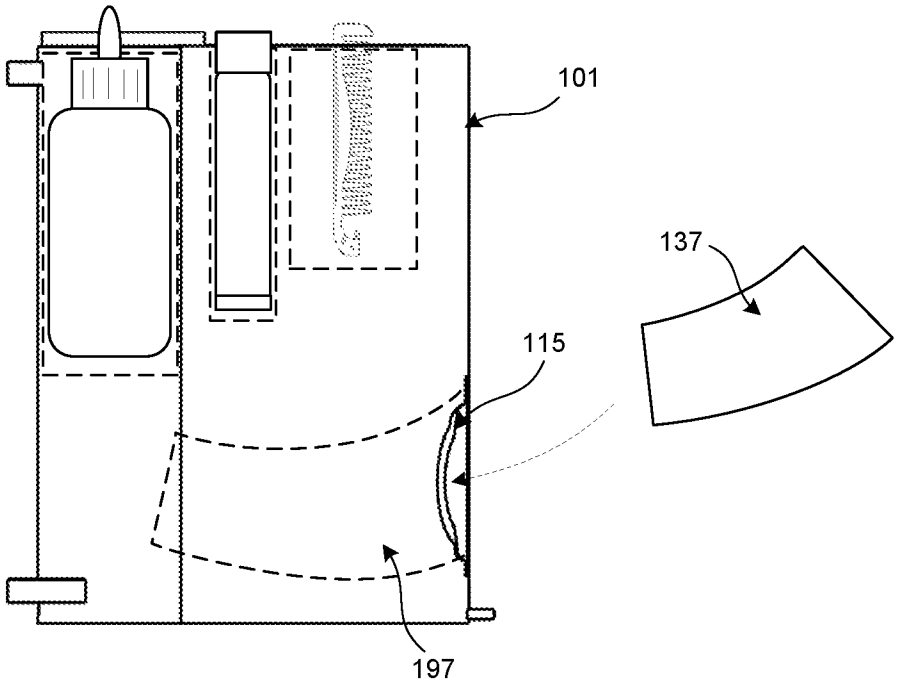
FIG. 17A-FIG. 17B illustrate an example of inserting the template and guide in its compacted state into the guide slot of the housing, according to an embodiment.
Figure 17A:
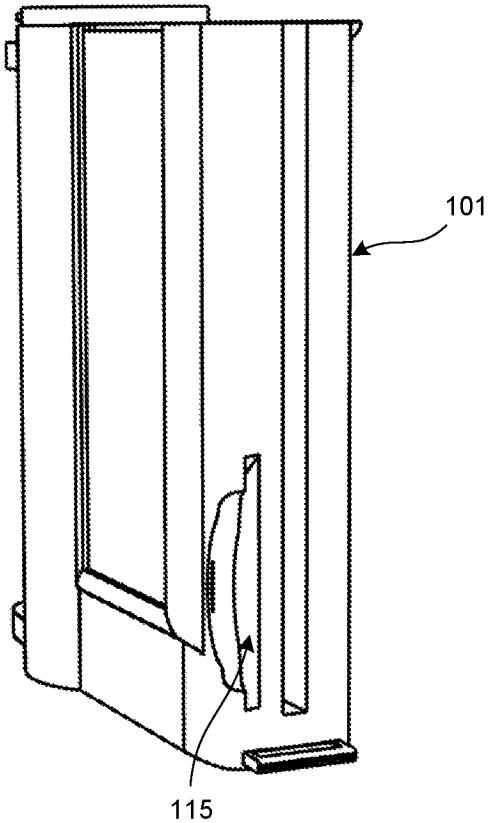
Figure 18B:
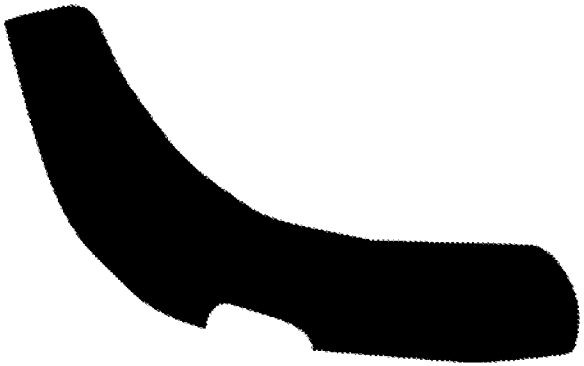
FIG. 18A-FIG. 18D illustrate a variety of shapes and configuration of the template and guide, according to an embodiment.
Figure 18D:
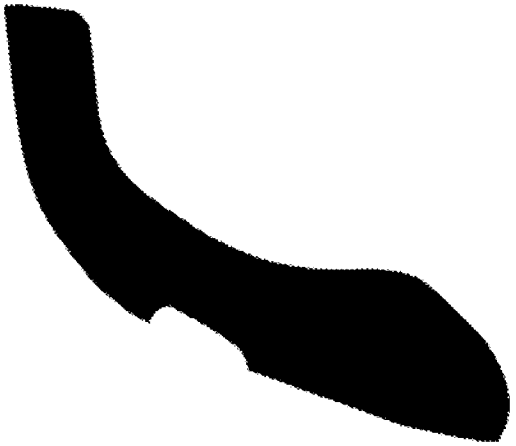
Figure 18A:
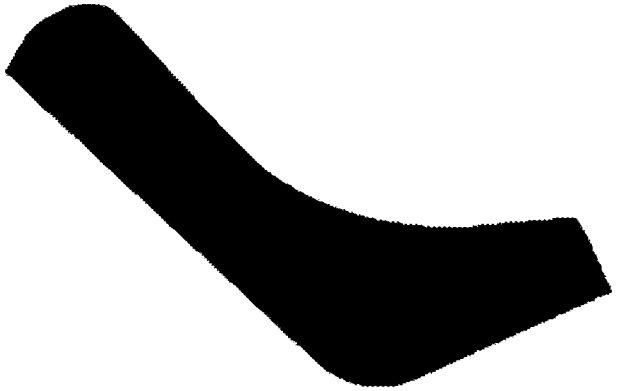
Figure 18C:
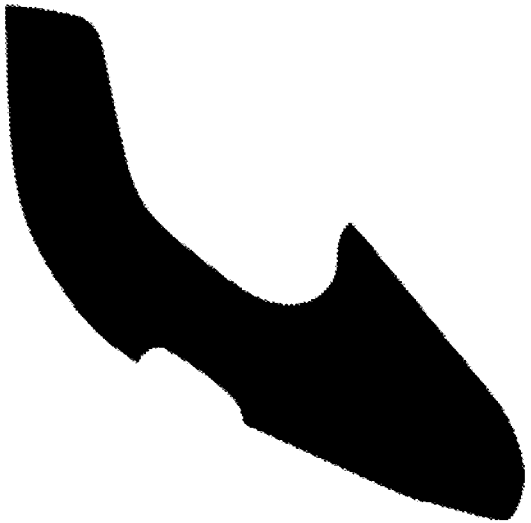

FIG. 17A-FIG. 17B illustrate an example of inserting the template and guide 137 in its compacted state into the guide slot 115 of the housing 101, according to an embodiment. With the template and guide 137 completely folded, flattened, and in a compact state, the template and guide 137 may be inserted into the guide slot 115 along a short end of the template and guide 137 into a slot area 197 having a shape matching the shape of the folded template and guide 137.

FIG. 18A-FIG. 18D illustrate a variety of shapes and configuration of the template and guide 137, according to an embodiment. These shapes include various beard styling templates having different types beard styling curves used to shape the beard of the user.

Figure 19A:
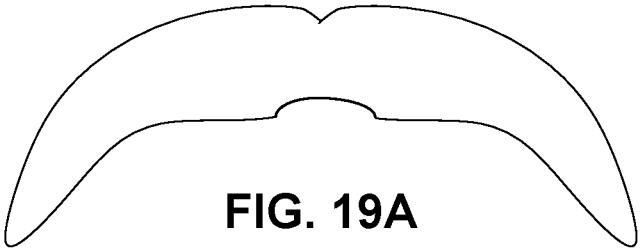
FIG. 19A-FIG. 19C illustrate other configurations of the template and guide, according to an embodiment.
Figure 19B:
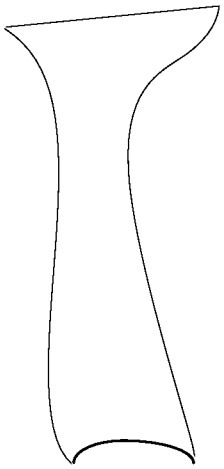
Figure 19C:
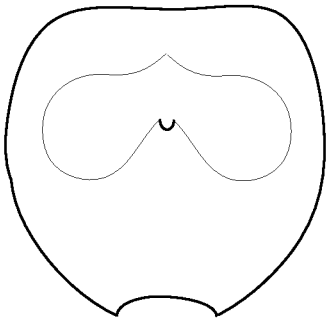

FIG. 19A-FIG. 19C illustrate other configurations of the template and guide 137, according to an embodiment. These shapes include a mustache guide template as shown in FIG. 19A, a sideburn guide template as shown in FIG. 19B, and a chin beard template shown in FIG. 19C for shaping various facial hair of the user.

Figure 20B:
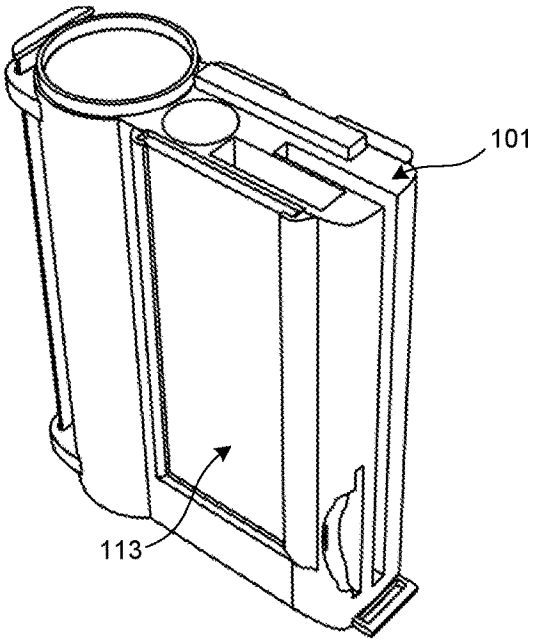
FIG. 20A-FIG. 20B illustrate the mirror or optical panel, according to an embodiment.
Figure 20A:
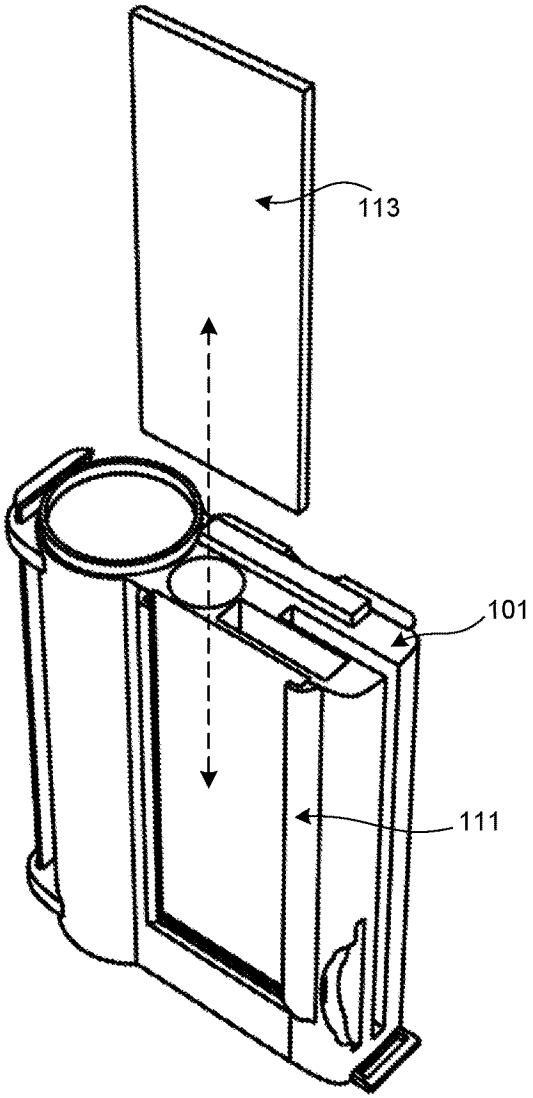

FIG. 20A-FIG. 20B illustrate the mirror or optical panel 113, according to an embodiment. In one implementation, the mirror or optical panel 113 is made to be detachable from the housing 101, allowing the user to replace the mirror or optical panel 113 with different types of panels including, for example, a solar panel, a replacement mirror, or writing panel.

Figure 21B:
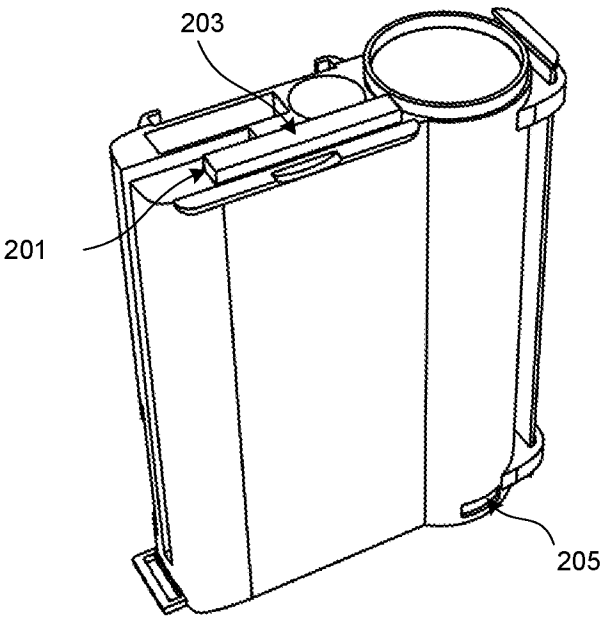
FIG. 21A-FIG. 21B illustrate the housing having a rechargeable battery compartment for receiving a rechargeable battery, according to an embodiment.
Figure 21A:
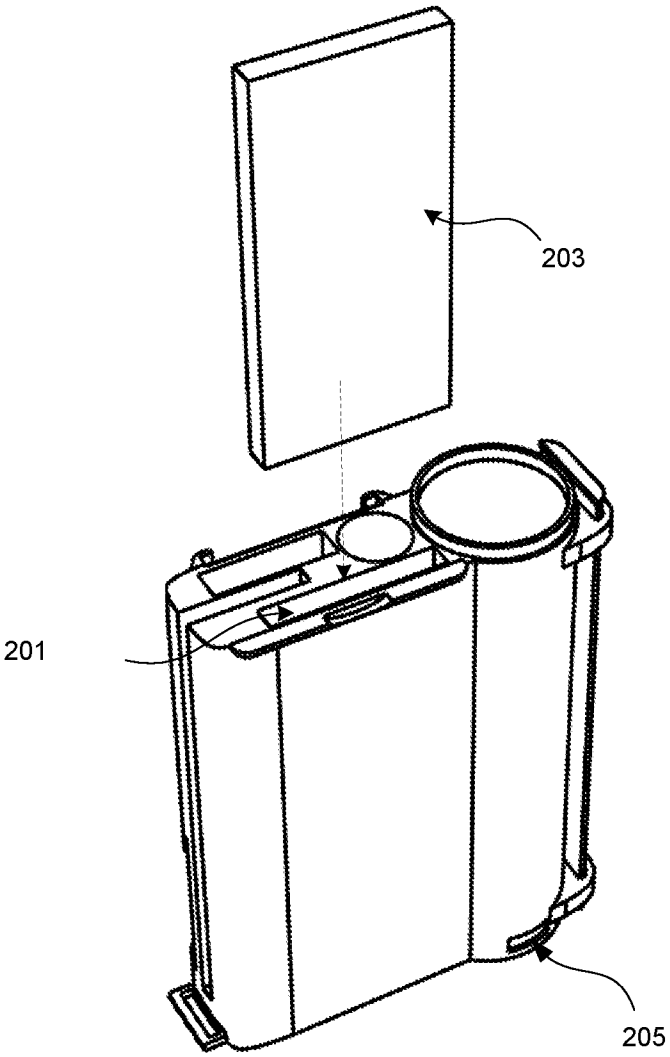

FIG. 21A-FIG. 21B illustrate the housing 101 having a rechargeable battery compartment 201 for receiving a rechargeable battery 203, according to an embodiment. The rechargeable battery 203 may be used to power the optional solar panel or used to power external electronic devices via a USB port 205.

Figure 22:
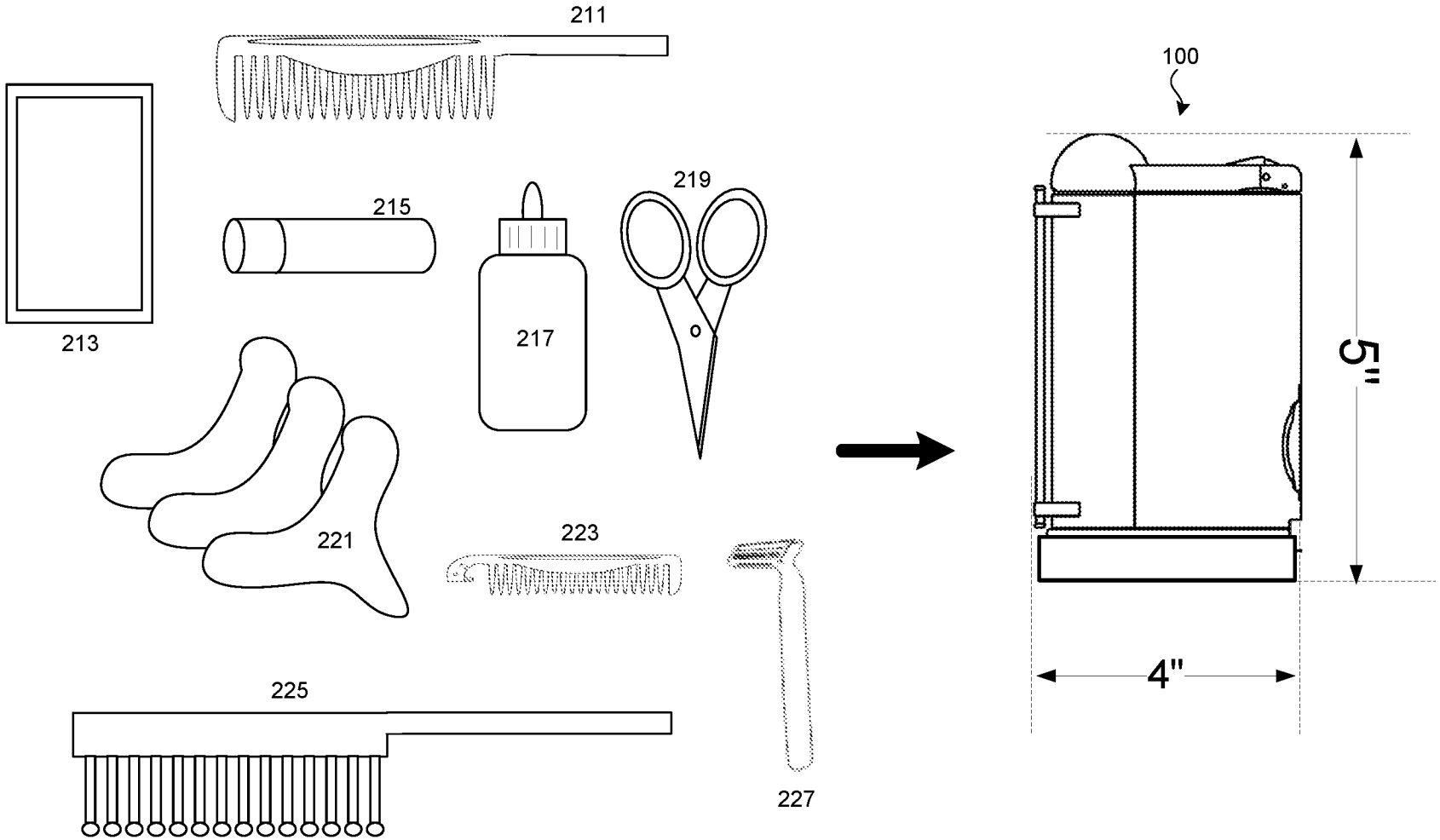
FIG. 22 illustrates an example of the storage capability, available tools, and space savings using the pocket utility case and travel tool, according to an embodiment.

FIG. 22 illustrates an example of the storage capability, available tools, and space savings using the pocket utility case and travel tool 100, according to an embodiment. In one configuration, the pocket utility case and travel tool 100 is capable of storing a large 8" comb 211, a 4"×2" mirror 213, beard wax stick 215, beard oil 217, scissors 219, 3 beard styling guides 221, a beard comb 223, a 8" brush 225, and a razor equivalent 227 in the highly compact and pocket size utility case having an approximate dimension of 5" (H)×4" (W)×1.5" (D).

Figure 23:
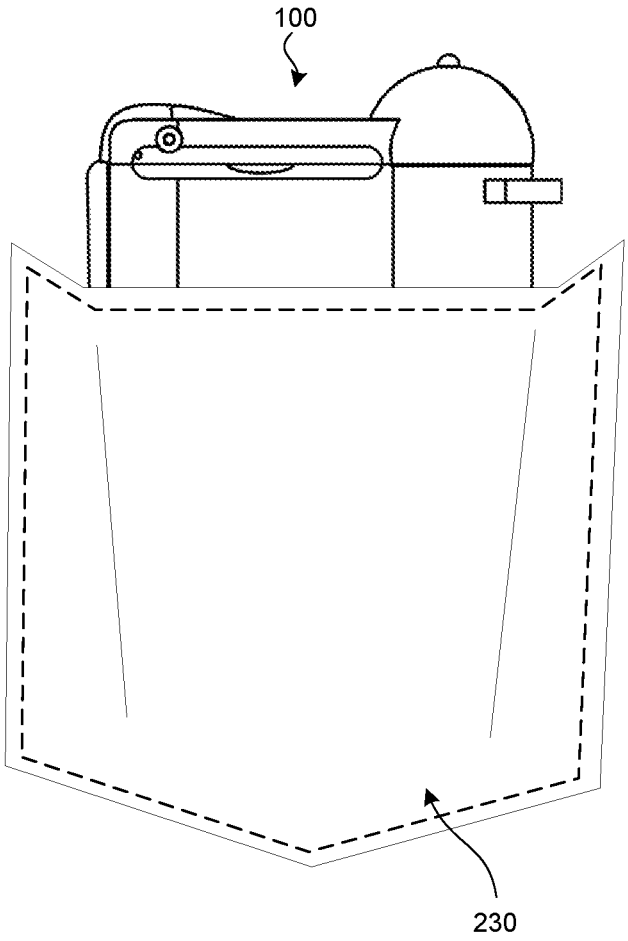
FIG. 23 illustrates the pocket utility case and travel tool inserted into a pocket of the user, according to an embodiment.

FIG. 23 illustrates the pocket utility case and travel tool 100 inserted into a standard pocket 230 of the user, according to an embodiment. This feature provides the user the capability of carrying personal products and tools in a small, durable and compact case in their pocket which is otherwise not possible if carried as separate items.

Several advantages of the pocket utility case and travel tool 100 may include, for example, 1) several quickly assembled personal utility tools for maintaining oral hygiene, personal hygiene and grooming including a full size razor and full size toothbrush, full size comb, full size brush, scissors, a beard brush, styling templates include beard shaping templates, mustache shaping templates, and side burn shaping templates; 2) personal products hair products, beard products, and oral products; and 3) other accessories such as a mirror or optical panel for personal care. The pocket utility case and travel tool 100 with its space saving features and quickly assembled personal utility tools provide the user a complete and ready personal package, saving them time while on the go.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is:

1. A personal grooming utility case for storing a plurality of personal care products and a plurality of personal utility tools, the personal grooming utility case comprising:

a housing having a top portion, a bottom portion, a first side portion, and a second side portion, and a plurality of storage compartments, wherein the first side portion includes a comb slot disposed within the first side portion and extending from the top portion of the housing to the bottom portion of the housing;

a detachable lid coupled to the top portion of the housing; and a pivoting comb coupled to the detachable lid at a pivot point, wherein the comb slot is configured to receive the pivoting comb when the detachable lid is attached to the housing, and wherein the pivoting comb is perpendicular to the detachable lid when the pivoting comb is inserted into the comb slot.

2. The personal grooming utility case of claim 1, wherein the plurality of storage compartments includes a tube-shaped storage compartment disposed on the second side portion of the housing, a panel frame disposed n a front side of the housing, and a guide slot disposed on the bottom portion of the housing.

3. The personal grooming utility case of claim 2, wherein the housing includes a hemispherical shell adapted to fit into a portion of the tube-shaped storage compartment when the detachable lid is attached to the housing.

4. The personal grooming utility case of claim 2, wherein the tube-shaped storage compartment is configured to store a beard oil bottle, a hair spray bottle, or a hair gel bottle.

5. The personal grooming utility case of claim 2, wherein the panel frame is configured to support a mirror or an optical panel.

6. The personal grooming utility case of claim 2, wherein the guide slot is configured to store a hair styling template and guide.

7. The personal grooming utility case of claim 6, wherein the hair styling template and guide is at a compacted state when the hair styling template and guide is folded along a fold wing, and wherein the hair styling template and guide is at a unfolded state when the hair styling template and guide is unfolded along the fold wing.

8. The personal grooming utility case of claim 1, wherein the second side portion includes a first strap clip coupled to the top portion of the housing and a second strap clip coupled to the bottom portion of the housing.

9. The personal grooming utility case of claim 1, wherein the pivoting comb is interchangeable with a replacement comb having a different size, style or comb teeth.

10. The personal grooming utility case of claim 1, wherein the personal grooming utility case is configured to fit into pant pockets, shirt pockets or sweater pockets.

* * * * *